US008948628B2

(12) United States Patent
Okunishi et al.

(10) Patent No.: US 8,948,628 B2
(45) Date of Patent: Feb. 3, 2015

(54) IMAGE FORMING APPARATUS CALCULATING POWER CONSUMPTION AMOUNT

(71) Applicant: Konica Minolta, Inc., Tokyo (JP)

(72) Inventors: Kazuo Okunishi, Okazaki (JP); Minoru Asakawa, Tokyo (JP); Yu Tanaka, Toyokawa (JP); Natsuyo Higashi, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 13/645,329

(22) Filed: Oct. 4, 2012

(65) Prior Publication Data

US 2013/0094876 A1 Apr. 18, 2013

(30) Foreign Application Priority Data

Oct. 7, 2011 (JP) ..... 2011-222404
Oct. 7, 2011 (JP) ..... 2011-222536

(51) Int. Cl.
*G03G 15/20* (2006.01)
*G03G 15/00* (2006.01)

(52) U.S. Cl.
CPC ..... *G03G 15/80* (2013.01); *G03G 15/5004* (2013.01)
USPC ..... 399/37; 399/88; 399/67

(58) Field of Classification Search
USPC ..... 399/37
See application file for complete search history.

(56) References Cited

U.S. PATENT DOCUMENTS 6,126,281 A * 10/2000 Shimoda et al. ..... 347/101
6,470,157 B2 * 10/2002 Taneko ..... 399/88
6,950,618 B2 * 9/2005 Shimizu et al. ..... 399/122
8,369,721 B2 * 2/2013 Yamada ..... 399/37
2010/0238293 A1 * 9/2010 Baronas et al. ..... 348/160
2011/0064431 A1 * 3/2011 Kohri et al. ..... 399/37

FOREIGN PATENT DOCUMENTS

JP 10-10914 1/1998
JP 2000-293059 10/2000
JP 2002-304092 10/2002

(Continued)

OTHER PUBLICATIONS

Notice of Grounds of Rejection mailed Oct. 22, 2013, directed to JP Application No. 2011-222404; 13 pages.

(Continued)

*Primary Examiner* — Clayton Laballe
*Assistant Examiner* — Leon W Rhodes, Jr.
(74) *Attorney, Agent, or Firm* — Holtz, Holtz, Goodman & Chick PC

(57) ABSTRACT

An image forming apparatus includes a first power calculator for calculating a power consumption amount of a driving load unit and a post-processing device based on at least one of measured values of a voltage and a current, which are supplied to the driving load unit and the post-processing device; second and third power calculators for calculating power consumption amounts of a fixing heater driving unit and a controller based on an operating state and an operating time of the image forming apparatus; and a power summing-up unit for calculating a power consumption amount of the image forming apparatus by summing up the power consumption amount calculated by the first power calculator and the power consumption amount predicted by each of the second and third power calculators.

30 Claims, 28 Drawing Sheets

(56) References Cited

FOREIGN PATENT DOCUMENTS

| | | |
|---|---|---|
| JP | 2004-037699 | 2/2004 |
| JP | 2005-132045 | 5/2005 |
| JP | 2005-148667 | 6/2005 |
| JP | 2006-039443 | 2/2006 |
| JP | 2010-005809 | 1/2010 |
| JP | 2010-162742 | 7/2010 |
| JP | 2011-085796 | 4/2011 |
| JP | 2011085796 A * | 4/2011 ..... G03G 21/00 |

OTHER PUBLICATIONS

Notice of Grounds of Rejection mailed Oct. 22, 2013, directed to JP Application No. 2011-222536; 13 pages.

Japanese Notice of Allowance dated Mar. 18, 2014 (and English translation thereof) in counterpart Japanese Application No. 2011-222404.

* cited by examiner

FIG.8

| CODE | NAME | VALUE |
|---|---|---|
| T1 | SAMPLING PERIOD OF 24V CURRENT MONITOR | 5 msec |
| N1 | SAMPLING NUMBER OF 24V CURRENT MONITOR | 200 times |

FIG.12

| RATED POWER OF HEATER (W) | |
|---|---|
| Long | Short |
| 1180 | 790 |

FIG.14

| NUMBER | STATE | FORMULA | |
|---|---|---|---|
| | | Long | Short |
| 1 | THROUGH-UP CONTROL STATE | A-1 | A-2 |
| 2 | THROUGH-DOWN CONTROL STATE | A-3 | A-4 |
| 3 | FULLY TURNED-ON STATE | A-5 | A-6 |

FIG.15

| | | | |
|---|---|---|---|
| A-1 | P*t=1180*0.5*t | t=t2-t1 | Ws |
| A-2 | P*t=790*0.5*t | t=t2-t1 | Ws |
| A-3 | P*t=0.5*(1180+500)*t | t=t4-t3 | Ws |
| A-4 | P*t=0.5*(790+335)*t | t=t4-t3 | Ws |
| A-5 | P*t=1180*t | t=t3-t2 | Ws |
| A-6 | P*t=790*t | t=t3-t2 | Ws |

FIG.18

| CODE | NAME | VALUE |
|---|---|---|
| T2 | SAMPLING PERIOD OF IH GIVEN INSTRUCTED POWER | 100 msec |
| N2 | SAMPLING NUMBER OF IH GIVEN INSTRUCTED POWER | 10 times |
| R1 | VOLTAGE DROP CORRECTION | 1.03 |

FIG.20

| STATE | POWER CONSUMPTION PARAMETER P IN UNITS OF SAMPLING PERIOD (W/0.1s) |
|---|---|
| WARM-UP STATE | P1 |
| POWER SAVING STATE | P2 |
| STANDBY STATE | P3 |
| PRINTING STATE | P4 |

FIG.22

| STATE | POWER CONSUMPTION PARAMETER Q IN UNITS OF SAMPLING PERIOD (W/0.1s) |
|---|---|
| WARM-UP STATE | Q1 |
| POWER SAVING STATE | Q2 |
| STANDBY STATE, OR PRINTING STATE IN WHICH PAGE INSERTING MODE IS NOT SELECTED | Q3 |
| PRINTING STATE IN WHICH PAGE INSERTING MODE IS SELECTED | Q4 |

FIG.26

102

ECOLOGICAL BAROMETER1 | ECOLOGICAL BAROMETER2

| | APRIL | MAY | LAST MONTH | THIS MONTH |
|---|---|---|---|---|
| ACCUMULATED TIME IN CURRENT-CARRYING STATE (h) | 0.0 | 0.0 | 0.0 | 0.2 |
| ACCUMULATED TIME IN STANDBY STATE (h) | 0.0 | 0.0 | 0.0 | 0.2 |
| ACCUMULATED TIME IN POWER SAVING STATE (h) | 0.0 | 0.0 | 0.0 | 0.0 |
| ACCUMULATED TIME IN OPERATING STATE (h) | 0.0 | 0.0 | 0.0 | 0.0 |
| POWER CONSUMPTION AMOUNT(kWh) | 0.00 | 0.00 | 0.00 | 0.01 |
| EMISSION OF CO2(kg) | 0.00 | 0.00 | 0.00 | 0.00 |

CLOSE

IMAGE FORMING APPARATUS CALCULATING POWER CONSUMPTION AMOUNT

This application is based on Japanese Patent Applications No. 2011-222404 and No. 2011-222536 filed with the Japan Patent Office on Oct. 7, 2011, the entire contents of which are hereby incorporated by reference.

BACKGROUND OF THE INVENTION

1. Field of the Invention

The present invention relates to an image forming apparatus, more particularly to image forming apparatuses, such as a copying machine, a facsimile machine, and a printer.

2. Description of the Related Art

Examples of an electrophotographic image forming apparatus include an MFP (Multi Function Peripheral) having a scanner function, a facsimile function, a copying function, a function as a printer, a data communication function, and a server function, a facsimile machine, a copying machine, and the printer.

A demand for reduction of power consumption amount of the image forming apparatus including the MFP is increasing with an increasing worldwide interest in an environment, an increasing energy saving consciousness, and an increasing emission reduction consciousness of carbon dioxide. In order that a user checks whether the image forming apparatus is used by a method contributing power saving (a method that is not contrary to the power saving) or whether power is surely reduced, there is proposed a function of displaying the power consumption amount of the image forming apparatus or a function of providing the power consumption amount of the image forming apparatus to a computer out of the image forming apparatus through a network. However, there has not yet been a technology of accurately measuring or calculating the power consumption amount of the image forming apparatus.

Originally the power consumption amount of the image forming apparatus varies according to an operating state of the image forming apparatus. For example, in a standby state that is a state in which printing can be performed without waiting time, power consumption is greater than that of a power saving state that is a state in which some functions are stopped. A state in which the image forming apparatus performs color printing is greater than a state in which the image forming apparatus performs monochrome printing in the power consumption. The conventional function of displaying the power consumption amount places a high value on user's feeling that the power consumption amount decreases after a predetermined period compared with the previous power consumption amount in the case that the user changes settings related to an energy saving function, such as a setting related to a time necessary to transition to the power saving state or in the case that the image forming apparatus starts a mode in which the monochrome printing is recommended. Accordingly, a little value is placed on accuracy of the displayed power consumption amount, and there are few efforts for improving the accuracy of the power consumption amount.

However, with an increasing sense of crisis over global warming, the situation is changed by a worldwide movement in which the emission reduction of carbon dioxide is promoted with a specific numerical target. For example, generally a reduction amount of the whole management target range is calculated by obtaining "a reduction amount of power consumption" or "an emission reduction amount of carbon dioxide calculated from the reduction amount of power consumption" with respect to each of various facilities, such as an air conditioner and the image forming apparatus, in a management target range of a firm or a office. Additionally, the further improvement is performed to the facility in which the target emission reduction amount is not achieved. As a result, there is a need for the accuracy of the power consumption information provided by the image forming apparatus.

The power consumption amount of each facility or a ratio of the power consumption amount of each facility to the whole power consumption amount depends on a season. For example, the power consumption of the air conditioner depends on the season, while the power consumption of an elevator is substantially kept constant throughout the year. Accordingly, the power consumption reduction amount or the target power consumption amount, which is allocated to each of devices, such as the image forming apparatus, varies in each month, and it is necessary to compare the power consumption reduction amount or the target power consumption amount to that of the same month a year ago. That is, the time in which it is required that the qualitative change in power consumption amount of the image forming apparatus is understandable is changed to the time in which it is required that the quantitative change in power consumption amount of the image forming apparatus is understandable.

For example, Documents 1 and 2 described below disclose a method for obtaining the power consumption amount of the image forming apparatus.

Document 1 discloses a technology of calculating a degree of energy saving based on a printing setting and counting results of the numbers of printed sheets and printed copies. In the technology disclosed in Document 1, the power consumption amount is calculated by an equation of "power consumption=(power consumption A during copy)×(printing operating time X)+(power consumption B during sleep×(sleep time Y)+(power consumption C during facsimile)×(facsimile operating time Z)". The fixed values A, B, and C may be decided in any way.

In a technology disclosed in Document 2, an AC power from an external power source is converted into a DC power of 24 V by an AC/DC converter, and the power consumption amount of the multi function peripheral is measured by a watt-hour meter directly connected to the AC/DC converter.

There is proposed an image forming apparatus having a function of obtaining the power consumption amount of the image forming apparatus to display or sum up a power usage status in order to assist the power saving effort of the user or the manager.

Conventionally, the power consumption amount of the image forming apparatus is measured by measuring a primary-side (a commercial power source of a transformer of the image forming apparatus) power supply voltage and a load current. For example, in a technology disclosed in Document 3 described below, a time in a power saving mode is measured, virtual power consumption is calculated from the measured time and unit power consumption in a previously-measured normal power mode, and a difference between a virtual power consumption amount in the normal power mode and the power consumption amount in the power saving mode is calculated as a power reduction value of the power saving mode.

Document 4 described below discloses a technology of calculating the power consumption amount by measuring a current and a voltage, which are supplied from the commercial power source to the image forming apparatus body. In the technology disclosed in Document 4, in the case that the user issues a printing instruction, image data in which image data of power information notification is added to image data of the printing instruction of the user is generated and printed on a predetermined sheet.

Document 1: Japanese Patent Publication Laying-Open No. 2002-304092

Document 2: Japanese Patent Publication Laying-Open No. 2006-39443

Document 3: Japanese Patent Publication Laying-Open No. 2005-132405

Document 4: Japanese Patent Publication Laying-Open No. 2010-5809

However, in the technologies disclosed in Document 1, unfortunately the power consumption amount obtained by the calculation has the low accuracy.

For example, during the copy, the power consumption depends heavily on a copy mode. This is because there are many copy modes. For example, the number of motors used and a kind of the motor vary according to a sheet feeding port through which the sheet used in the copy is fed. Because each of photosensitive bodies of four colors rotates in a color mode while only one-color photosensitive body rotates in a monochrome mode, the power consumption of the motor that rotates the photosensitive body varies largely between the color mode and the copy mode. An operating time of each member depends on a sheet size. The power consumption depends heavily on the voltage or the current from a high-voltage power supply that is one of main constituents of an electrophotographic process. The voltage or the current is decided to a proper value according to a usage environment by what is called image stabilizing control. The power consumption changes by environmental variations, such as a temperature and humidity. In a low-temperature environment, load torques of components, such as a gear and a bearing, increases by hardening of a grease. Accordingly, according to the environment, sometimes it is necessary to prepare different values as a parameter used to obtain the power consumption amount.

Accordingly, the number of parameters, such as the fixed values A, B, and C, which are necessary to calculate the power consumption amount, increase, and impractically a large amount of work and design man-hour are required to fix the many parameters in order to enhance the accuracy of the power consumption amount.

Additionally, the variation in power consumption associated with aging of the image forming apparatus is serious. In the bearing, the photosensitive body, and cleaning members, such as a transfer belt, the load torque is generated by friction and varies by the aging or a durability change. Accordingly, even if the printing is performed in the same operating mode, the current state of the load changes from the state of the load half a year ago or a year ago, and the power consumption also changes.

Therefore, the variation in power consumption associated with the aging of the image forming apparatus cannot be evaluated, even if the fixed value is set according to the usage method (the printing setting) of the image forming apparatus like Document 1. Even if a manufacturer of the image forming apparatus designs the fixed value over time using a trial model of the image forming apparatus, it is necessary to finely adjust the fixed value in the actual image forming apparatus that is mass-produced using a die. Therefore, depending on a correction scale, work to correct the parameter is required after start of the mass production of the image forming apparatus. Sometimes launching of the image forming apparatus is delayed as it takes to much time for the correction work.

In the technology disclosed in Document 2, when the power consumption of each load of the image forming apparatus is measured, it is necessary to provide the watt-hour meter in each load according to magnitude of the power consumption of each load, which results in a problem in that complication of the apparatus is caused.

The power consumption of the image forming apparatus including the MFP has the following characteristics. In the case that the operating state of the image forming apparatus is warm-up, the image forming apparatus continuously consumes the power ranging from hundreds of watts to one thousand and hundreds of watts in order to perform an operation to heat a fixing device to a predetermined temperature. In the case that the operating state of the image forming apparatus is printing, the image forming apparatus continuously consumes the power of hundreds of watts in order to drive the motor used in the printing. At the same time, the image forming apparatus intermittently consumes the power of hundreds of watts in order to perform a temperature control operation of the fixing device. In the case that the operating state of the image forming apparatus is standby, the image forming apparatus continuously consumes the power of tens of watts in a control circuit and the like. At the same time, the image forming apparatus intermittently consumes the power of one thousand and hundreds of watts in order to control the temperature of the fixing device. In the case that the operating state of the image forming apparatus is in power saving modes, such as the sleep mode, the image forming apparatus continuously consumes the small power of several watts for a long time in the control circuit and the like.

When the power consumption in each operating state is viewed from a time axis, the time in the maximum power consumption state has a small ratio, and the time in the minimum power consumption state (the power saving mode) has the largest ratio.

Accordingly, for example, in the case that the power consumption amount is measured in long periods, such as one week and one month, the variation in power consumption increases, and it is necessary for a power consumption measuring device to accurately measure the wide range of power consumption from low power consumption to high power consumption.

For example, when the wide range of power consumption is accurately measured by a power consumption measuring circuit inserted on the primary side, it is necessary that the power consumption measuring circuit have performance equivalent to a general-purpose measuring instrument, which results in a problem in that the configuration of the image forming apparatus becomes complicated and expensive. In the case that the power consumption measuring circuit is inserted on the primary side, it is necessary that a detection circuit in the power consumption measuring circuit and a portion in which a detection result is displayed be electrically insulated, which results in the problem in that the configuration of the image forming apparatus becomes complicated and expensive. Specifically, in the case that the power consumption amount is calculated based on a value, which is obtained by performing the AD (analog-digital) conversion of the primary-side current, because of the large variation in measured current, the high measurement accuracy of the current is hardly obtained in the inexpensive 10-bit AD converter.

Recently, the specific reduction target of the emitted carbon dioxide or the power consumption amount is indicated by the numerical value, the need for the measurement accuracy of the power consumption amount becomes severer. However, the degradation of the measurement accuracy of the power consumption amount due to the wide of measured power range is not considered in the technologies disclosed in Documents 3 and 4.

In the case that the power consumption of the image forming apparatus from the viewpoint of load variation, there are load variations of the kind of the sheet, an installation environment, and the aging in addition to the variation due to the operating state of the image forming apparatus. For example, in the case that attention is paid to the fixing device, the fixing device is deprived of a heat quantity by the sheet in addition to energy necessary to melt and fix toner. Because the heat quantity depends largely on a thickness or a water amount of the sheet, the heat quantity necessary for the fixing device varies according to the kind of the sheet. The load torque of the motor that drives the image forming apparatus depends on the environment. For example, in the low-temperature environment, the power consumption increases due to the hardening of the grease in the motor. Because of the aging of each component of the image forming apparatus, the image forming apparatus in the new state differs from the image forming apparatus after a long period of use in the toad torque, and the power consumption varies.

In the high-voltage power supply necessary for the electrophotographic process, an output voltage or an output current is adjusted by an image stabilizing operation. Therefore, the power consumption of the high-voltage power supply is not kept constant. In order to implement a quiet rotation, a cooling fan does not always rotate, but the rotation of the cooling fan is controlled by monitoring the temperature.

There is a conventional power consumption calculating method, in which an operating mode and a parameter of the power consumption are previously prepared according to the number of documents to be copied or the number of copies to be printed and the power consumption is calculated using the parameter. In the power consumption calculating method, the difference in power consumption due to the difference of the operating mode can be calculated with a certain level of accuracy. However, a large amount of parameters (pieces of information), such as an environmental condition, a durability condition, an image forming condition, the kind of the sheet, and the thickness of the sheet, are required in the case that an absolute value of the power consumption is calculated by the power consumption calculating method, and a large amount of programs are required in order to enhance detection accuracy of the power consumption amount. As a result, development of a large amount of programs and verification work to fix the parameter are generated.

That is, conventionally a proper power measuring method in which a balance between a product cost and a development cost is established is not proposed in order to enhance the detection accuracy of the power consumption of the image forming apparatus.

SUMMARY OF THE INVENTION

An object of the present invention is to provide an image forming apparatus that can accurately obtain the power consumption amount of the image forming apparatus.

Another object of the present invention is to provide an image forming apparatus that can suppress the complication of the apparatus configuration.

In accordance with an aspect of the present invention, an image forming apparatus includes: a first power calculator for calculating a power consumption amount of a first load of the image forming apparatus based on at least one of measured values of a voltage and a current, which are supplied to the first load; a power prediction unit for predicting a power consumption amount of a second load of the image forming apparatus based on an operating state and an operating time of the image forming apparatus; and a power summing-up unit for calculating a power consumption amount of the image forming apparatus by summing up the power consumption amount calculated by the first power calculator and the power consumption amount predicted by the power prediction unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 is a table illustrating examples of setting values of a time T1 and the number of times N1.

FIG. 12 is a table illustrating examples of rated powers of a long heater and a short heater.

FIG. 14 is a table schematically illustrating a relationship between a phase control state and a calculation formula of the power consumption amount.

FIG. 15 is a table schematically illustrating a calculation formula in FIG. 14.

FIG. 18 is a table illustrating examples of setting values of a time interval T2, the number of times N2, and a voltage drop correction coefficient R1.

FIG. 20 is a table illustrating a correspondence relationship between an operating state of the image forming apparatus and a power consumption parameter P.

FIG. 22 is a table illustrating a correspondence relationship between the operating state of the image forming apparatus and a power consumption parameter Q.

FIG. 26 is a view schematically illustrating a power information screen displayed on a display unit 102.

DESCRIPTION OF THE PREFERRED EMBODIMENTS

Hereinafter, an embodiment of the present invention will be described with reference to the drawings.

In the embodiment, an image forming apparatus forms an image by an electrophotographic system or an electrostatic recording system. By way of example, the image forming apparatus is an MFP having a scanner function, a facsimile function, a copying function, a function as a printer, a data communication function, and a server function. In addition to the MFP, the image forming apparatus may be a facsimile machine, copying machines, such as a PPC (Plain Paper Copier), or printers, such as a laser printer. The image forming apparatus may form either a monochrome image or a color image, and the image forming apparatus may form the image by either an analog system or a digital system.

Configuration of Image Forming Apparatus

A configuration of the image forming apparatus of the embodiment will be described below.

Figure 1:
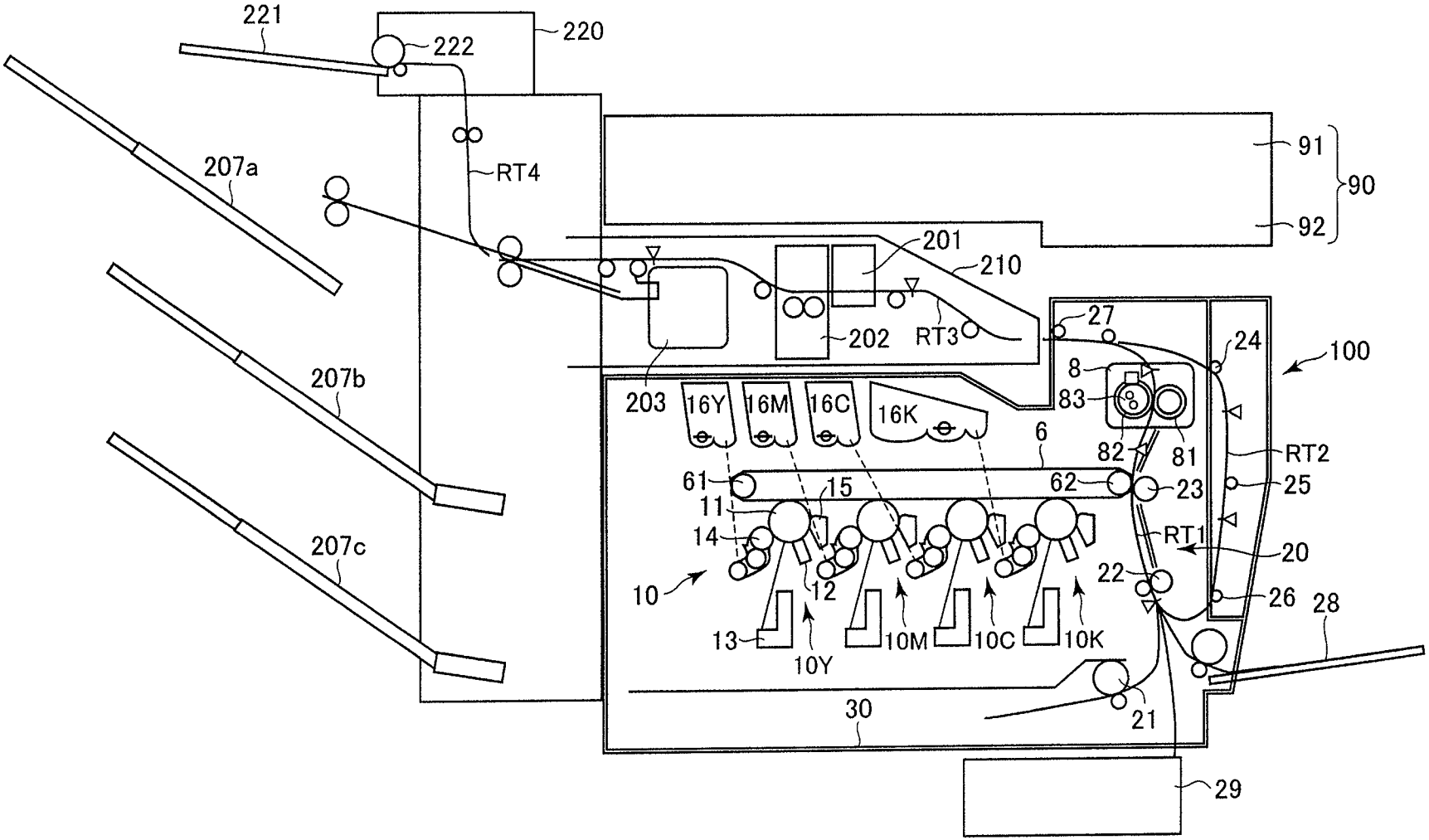
FIG. 1 is a sectional view schematically illustrating a configuration of an image forming apparatus according to an embodiment of the present invention.

Referring to FIG. 1, the image forming apparatus of the embodiment includes an image forming apparatus body 100 and post-processing devices 210 (a post-processing device 1) and 220 (a post-processing device 2) that are peripheral devices added to image forming apparatus body 100. Image forming apparatus body 100 and post-processing devices 210 and 220 constitute a system. Post-processing device 210 has punching, folding, stapling, and sorting functions. Post-processing device 220 has a page inserting function. Post-processing device 220 has a page inserting function of inserting the sheet previously set to post-processing device 220 in a predetermined position of a sheet group printed by image forming apparatus body 100 and a function of stapling the sheet group after the sheet is inserted.

Image forming apparatus body 100 forms an image by the electrophotographic system. Image forming apparatus body 100 mainly includes a toner image forming unit 10, a sheet conveying unit 20, a fixing device (fixing unit) 8, and a scanner 90. Toner image forming unit 10 is what is called a tandem system. As needed basis, images of yellow (Y), magenta (M), cyan (C), and black (K) colors are combined to form a color image on the sheet.

Toner image forming unit 10 includes toner bottles 16Y, 16M, 16C, and 16K (hereinafter sometimes collectively referred to as a toner bottle 16) of four colors, an intermediate transfer belt 6, and four sets of printheads 10Y, 10M, 10C, and 10K.

Toner bottle 16 retains toner of each of YMCK colors. Toner bottle 16 is rotated by a driving motor (not illustrated), and the toner retained in toner bottle 16 is replenished to each of printheads 10Y, 10M, 10C, and 10K. The toner replenishing operation is performed when a toner amount decreases in a development device 14 of each of printheads 10Y, 10M, 10C, and 10K.

An intermediate transfer belt 6 has a circular shape, and is entrained about two rollers 61 and 62. Intermediate transfer belt 6 rotates in conjunction with sheet conveying unit 20. A secondary transfer roller 23 of sheet conveying unit 20 is disposed opposite intermediate transfer belt 6 at a position in which roller 62 contacts intermediate transfer belt 6. The sheet is conveyed while nipped between intermediate transfer belt 6 and secondary transfer roller 23.

Printheads 10Y, 10M, 10C, 10K are arrayed immediately below intermediate transfer belt 6, and form the Y, M, C, and K images on a photosensitive body 11. Each of printheads 10Y, 10M, 10C, 10K includes photosensitive body 11, a charger 12, an exposure device 13, a development device 14, and a cleaner 15. Based on image data of each of the YMCK colors, exposure device 13 forms a latent image on photosensitive body 11 that are evenly charged by charger 12. Development device 14 causes the toner of each color to adhere onto photosensitive body 11 on which the latent image is formed, thereby forming the toner image on photosensitive body 11 (development). Photosensitive body 11 transfers the toner image to intermediate transfer belt 6, and forms a mirror image of the four-color toner image, which is formed on the sheet, on intermediate transfer belt 6 (primary transfer). Then the toner image formed on intermediate transfer belt 6 is transferred to the sheet by secondary transfer roller 23 to which a high voltage is applied, thereby forming the toner image on the sheet (secondary transfer).

Fixing device 8 is a roller system, and includes a pressurizing roller 81, a heating roller 82, and a fixing heater 83. Fixing heater 83 is incorporated in heating roller 82. Fixing heater 83 generates heat by applying the voltage to fixing heater 83, thereby heating heating roller 82. In fixing device 8, the sheet on which the toner image is formed is conveyed while nipped between heating roller 82 and pressurizing roller 81, and the sheet is heated and pressurized. Therefore, fixing device 8 forms the image on the sheet by melting the toner adhering to the sheet. Fixing device 8 may be a belt system.

Sheet conveying unit 20 conveys the sheet, which is kept in a sheet feeding tray 30, one by one along a sheet passage route RT1 or RT2. Sheet conveying unit 20 includes a sheet feeding roller 21, a timing roller 22, secondary transfer roller 23, conveying rollers 24 to 26, and a sheet discharging roller 27. Sheet feeding roller 21, timing roller 22, and sheet discharging roller 27 are disposed in this order from an upstream side (the side of sheet feeding tray 30) toward a downstream side (the side of sheet discharging roller 27) in sheet passage route RT1. In each of sheet feeding roller 21, timing roller 22, secondary transfer roller 23, conveying rollers 24 to 26, and sheet discharging roller 27, for example, while the sheet is nipped between two rollers opposite each other, the rollers are rotated to convey the sheet. In addition to the above rollers, sheet conveying unit 20 may include a roller used to convey the sheet.

The sheet kept in sheet feeding tray 30 is fed one by one by sheet feeding roller 21. After the sheet is temporarily stopped in front of timing roller 22, the sheet is conveyed to secondary transfer roller 23 to form the toner image in a predetermined time. Then the toner image is fixed to the sheet by fixing device 8, and the sheet is discharged to the outside (post-processing device 210) of image forming apparatus body 100 by sheet discharging roller 27.

A double-side unit is attached to image forming apparatus body 100 in order to perform double-sided printing. In the case of the double-sided printing, after the sheet in which the image is formed on the surface passes through fixing device 8, sheet discharging roller 27 performs switch-back of the sheet, and the sheet is conveyed along sheet passage route RT2. After the sheet is conveyed along sheet passage route RT2 by conveying rollers 24 to 26, the sheet is conveyed along sheet passage route RT1 again, and the image is formed on a rear surface of the sheet. Then the sheet is discharged to the outside of image forming apparatus body 100 by sheet discharging roller 27.

Scanner 90 includes a document reader 91 that reads the image from the document and an automatic document feeder (ADF) 92 that continuously conveys the document to document reader 91.

A manual feed tray 28 and a lower sheet feeding cassette 29 may be further provided in image forming apparatus body 100.

Post-processing device 210 includes a punching unit 201 that performs punching processing to the sheet conveyed along a sheet passage route RT3, a folding unit 202 that performs folding processing to the sheet conveyed along sheet passage route RT3, a stapler 203 that performs stapling processing to the sheet conveyed along sheet passage route RT3, and discharge trays 207*a* to 207*c* to which the sheet, to which the post-processing is performed, is discharged.

Post-processing device 220 includes a sheet feeding tray 221 in which the sheet to be inserted is disposed and a sheet feeding roller 222 that feeds the sheet disposed in sheet feeding tray 221 to a sheet passage route RT4. The sheet fed by sheet feeding roller 222 is conveyed to sheet passage route RT3 through sheet passage route RT4.

Figure 2:
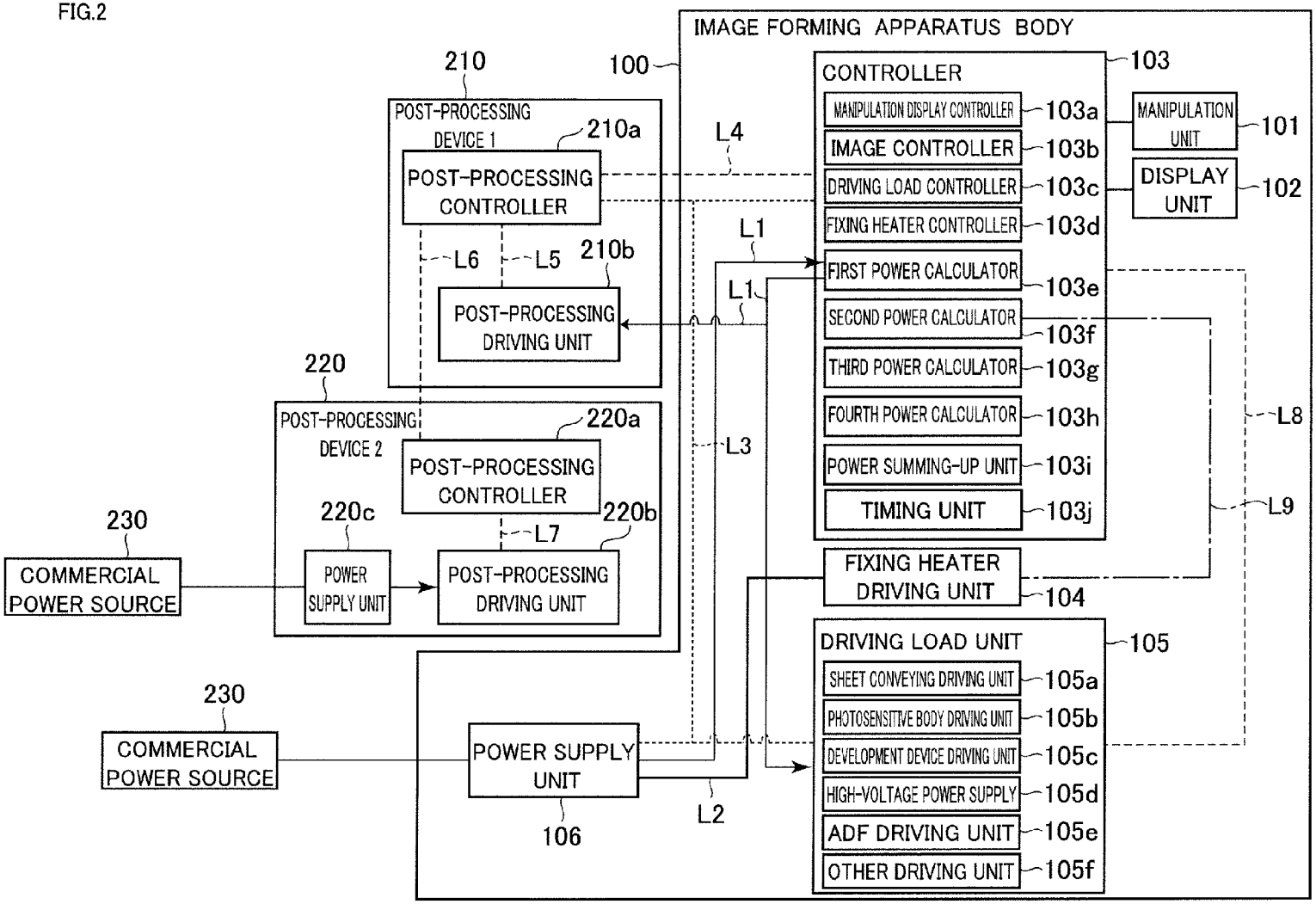
FIG. 2 is a block diagram illustrating a control configuration of the image forming apparatus of the embodiment.

FIG. 2 is a block diagram illustrating a control configuration of the image forming apparatus of the embodiment.

Referring to FIG. 2, image forming apparatus body 100 includes a manipulation unit 101, a display unit 102, a controller 103, a fixing heater driving unit 104, a driving load unit 105, and a power supply unit 106 that is a DC power supply. Power supply unit 106 receives a power from a commercial power source 230 (for example, 100 V), and supplies the power to each unit of image forming apparatus body 100. For example, power supply unit 106 supplies the power at a voltage of 24 V to driving load unit 105 and a post-processing driving unit 210*b* of post-processing device 210 through a driving system power supply line (middle power system line) L1. Power supply unit 106 supplies the power of a primary-side power supply to fixing heater driving unit 104 through a fixing system power supply line (high power system line) L2. For example, power supply unit 106 supplies the power at a voltage of 3.3 V to controller 103 and a post-processing controller 210*a* of a post-processing device 1 through a control system power supply line (low power system line) L3.

Manipulation unit 101 receives various instructions related to the image forming apparatus from the user.

Display unit 102 displays various setting items related to the image forming apparatus and a message.

Controller 103 includes a CPU (Central Processing Unit), a RAM (Random Access Memory), and a ROM (Read Only Memory), and controls the whole image forming apparatus. Controller 103 includes a manipulation display controller 103*a*, an image controller 103*b*, a driving load controller 103*c*, and a fixing heater controller 103*d*. Manipulation display controller 103*a* controls manipulation unit 101 and display unit 102, which are user interfaces related to the image formation. Based on the image data, image controller 103*b* outputs exposure data to exposure device 13 in each page of the sheet. Driving load controller 103*c* controls an operation of the motor of driving load unit 105, and the motor drives image forming apparatus. Fixing heater controller 103*d* controls an operation of fixing heater driving unit 104.

Fixing heater driving unit 104 is connected to controller 103, and drives fixing heater 83 based on an instruction of controller 103*d*.

Driving load unit 105 includes a sheet conveying driving unit 105*a*, a photosensitive body driving unit 105*b*, a development device driving unit 105*c*, a high-voltage power supply 105*d*, an ADF driving unit 105*e* and other driving units 105*f*. Sheet conveying driving unit 105*a* is a motor that drives a roller of sheet conveying unit 20. Photosensitive body driving unit 105*b* is a motor that drives a roller of photosensitive body 11. Development device driving unit 105*c* is a motor that drives a roller of development device 14. High-voltage power supply 105*d* provides a potential to at least one of photosensitive body 11 and development device 14. ADF driving unit 105*e* is a motor that drives a roller of automatic document feeder 92. Other driving units 105*f* are motors except the above motors in the image forming apparatus. Driving load unit 105 is connected to controller 103 through a control signal line L8.

Post-processing device 210 includes a post-processing controller 210*a* and a post-processing driving unit 210*b*. Post-processing controller 210*a* is connected to controller 103 through a control signal line L4, and connected to post-processing driving unit 210*b* through a control signal line L5. Post-processing controller 210*a* controls post-processing driving unit 210*b* based on an instruction from controller 103. Post-processing driving unit 210*b* is a motor that drives a finisher, and the finisher performs post-processing to the sheet after the image formation.

Post-processing device 220 includes a post-processing controller 220*a*, a post-processing driving unit 220*b*, and a power supply unit 220*c*. Post-processing controller 220*a* is connected to post-processing controller 210*a* through a control signal line L6, and connected to post-processing driving unit 220*b* through a control signal line L7. Post-processing controller 220*a* controls post-processing driving unit 220*b* based on the instruction from controller 103. Post-processing driving unit 210*b* drives driving members, such as a roller in post-processing device 220. Power supply unit 220*c* receives power from commercial power source 230, and supplies the power to post-processing driving unit 220*b* at a voltage into which the voltage at commercial power source 230 is converted. That is, post-processing device 220 does not receive the supply of the power from power supply unit 106 of image forming apparatus body 100, but receives the supply of the power from power supply unit 220*c* different from power supply unit 106.

Controller 103 further includes first to fourth power calculators 103*e* to 103*h*, a power summing-up unit 103*i*, and a timing unit 103*j*. First power calculator 103*e* calculates a power consumption amount of a load based on at least one of measured values of the voltage and the current, which are supplied to the load. On the other hand, second power calculator 103*f*, third power calculator 103*g*, and fourth power calculator 103*h* predict the power consumption amount of the load based on an operating state and an operating time of the image forming apparatus. Particularly, first power calculator 103*e* is connected between power supply unit 106 and each of driving load unit 105 and post-processing driving unit 210*b*. Second power calculator 103*f* is connected to fixing heater driving unit 104 through a control signal line L9. Power summing-up unit 103*i* calculates the power consumption amount of the image forming apparatus by summing up the power consumption amount calculated by first power calculator 103*e* and the power consumption amounts predicted by second power calculator 103*f*, third power calculator 103*g*, and fourth power calculator 103*h*.

Timing unit 103*j* measures a current clock time and a predetermined time interval. Timing unit 103*j* also measures an accumulated time of operating states (such as a current-carrying time, a standby time, a power saving time, and an operating time) of the image forming apparatus. The timing result is stored in a memory (for example, a nonvolatile RAM in a ROM 333 (FIG. 3)).

Post-processing device 220 that is of a peripheral device independently having a power supply may be eliminated in FIG. 2. In this case, fourth power calculator 103*h* is also eliminated. In both image forming apparatus body 100 and the peripheral device, generally the received power of the commercial power source is used while converted into the DC power supply having the voltage of 24 V or 3.3 V. However, from the viewpoint of a balance between a capacity and a cost of the power supply, there are the case that the power is supplied from image forming apparatus body 100 to the peripheral device and the case that peripheral device independently includes the power supply. For the frequently-equipped peripheral device, generally a power capacity for the peripheral device is previously allocated to power supply unit 106 of image farming apparatus body 100, and image forming apparatus body 100 supplies the power to the peripheral device. On the other hand, for the rarely-equipped peripheral device or the peripheral device having a low operating rate, generally the power supply is independently provided in the peripheral device such that the cost of the power supply of the peripheral device is not added on the cost of image forming apparatus body 100. Frequently this kind of peripheral device is a peripheral device (second peripheral device) attached to the peripheral device.

Figure 3:
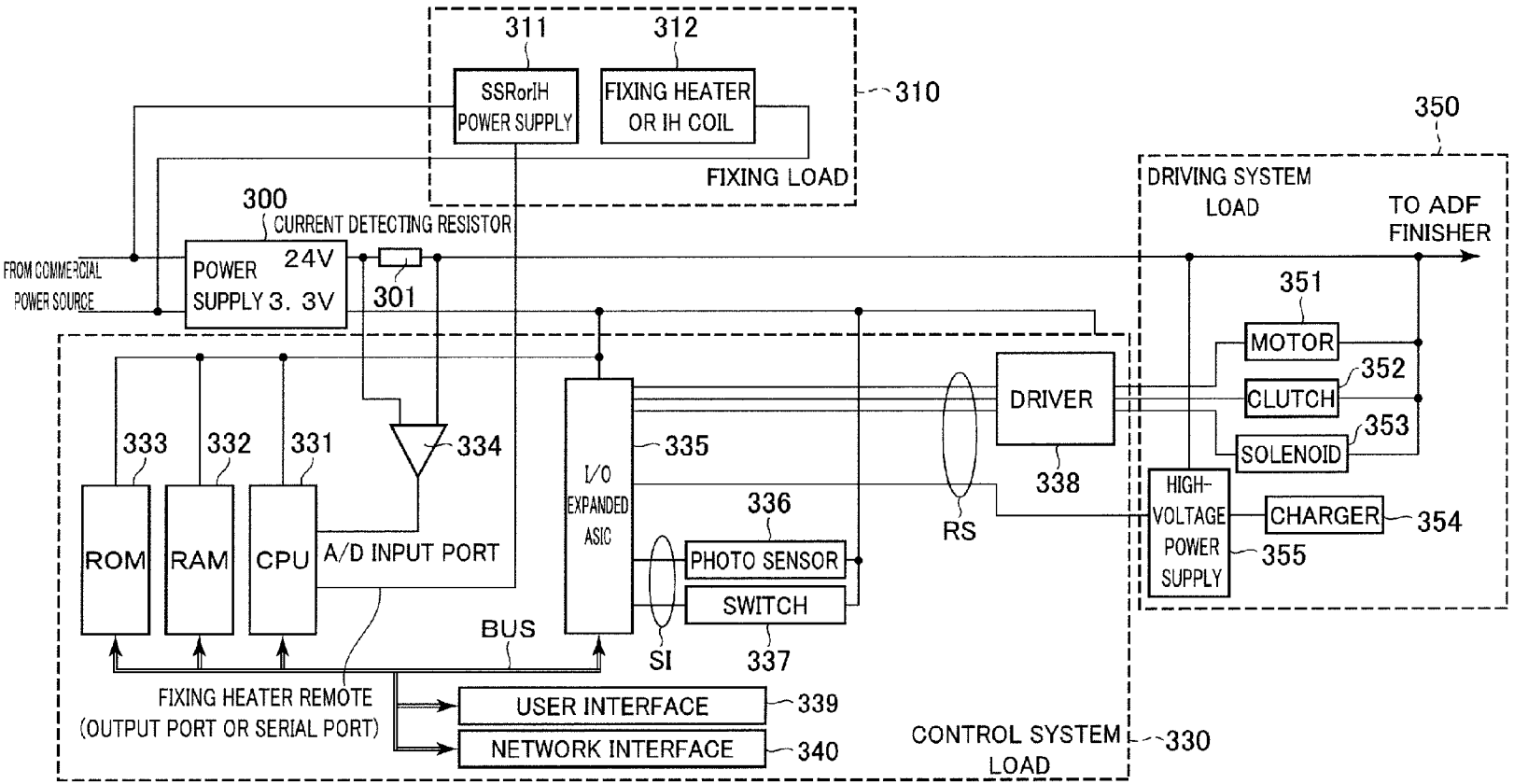
FIG. 3 is a view schematically illustrating a circuit configuration of the image forming apparatus of the embodiment.

FIG. 3 is a view schematically illustrating a circuit configuration of the image forming apparatus of the embodiment.

Referring to FIG. 3, a power supply 300 converts the voltage at commercial power source 230 into the voltage of 24 V and the voltage of 3.3 V. The voltage converted into 24 V is supplied from power supply 300 to a driving system load 350 (driving load unit 105). A current detecting resistor 301 is connected between power supply 300 and driving system load 350. The voltage converted into 3.3 V is supplied from power supply 300 to control system load 330 (controller 103).

Control system load 330 includes a CPU 331, a RAM 332, a ROM 333, an amplifier 334, an I/O expanded ASIC (Application Specific Integrated Circuit) 335, a photo sensor 336, a switch 337, a driver 338, a user interface 339, and a network interface 340. CPU 331, RAM 332, ROM 333, I/O expanded ASIC 335, user interface 339, and network interface 340 are connected to one another through a bus BUS. Amplifier 334 amplifies the current passed through current detecting resistor 301, and outputs the current to an A/D input port of CPU 331. I/O expanded ASIC 335 receives sensor inputs SI from photo sensor 336 and switch 337, and outputs a remote signal RS to driver 338 and high-voltage power supply 335.

Driving system load 350 includes a motor 351, a clutch 352, a solenoid 353, a charger 354, and a high-voltage power supply 355. The operations of motor 351, clutch 352, and solenoid 353 are controlled by driver 338 of control system load 330. High-voltage power supply 355 controls the potential at charger 354 based on remote signal RS output from I/O expanded ASIC 335 of control system load 330.

A fixing load 310 (fixing heater 83 and fixing heater driving unit 104) includes an SSR (Solid State Relay) or IH (Induction Heating) power supply 311 and a fixing heater or IH coil 312. The voltage at commercial power source 230 is converted into a proper voltage by SSR or IH power supply 311, and applied to fixing heater or IH coil 312. SSR or IH power supply 311 is connected to CPU 331 through a fixing heater remote (an output port or a serial port).

Outline of Power Consumption Amount Calculating Method

Then an outline of a power consumption amount calculating method will be described.

Figure 4:
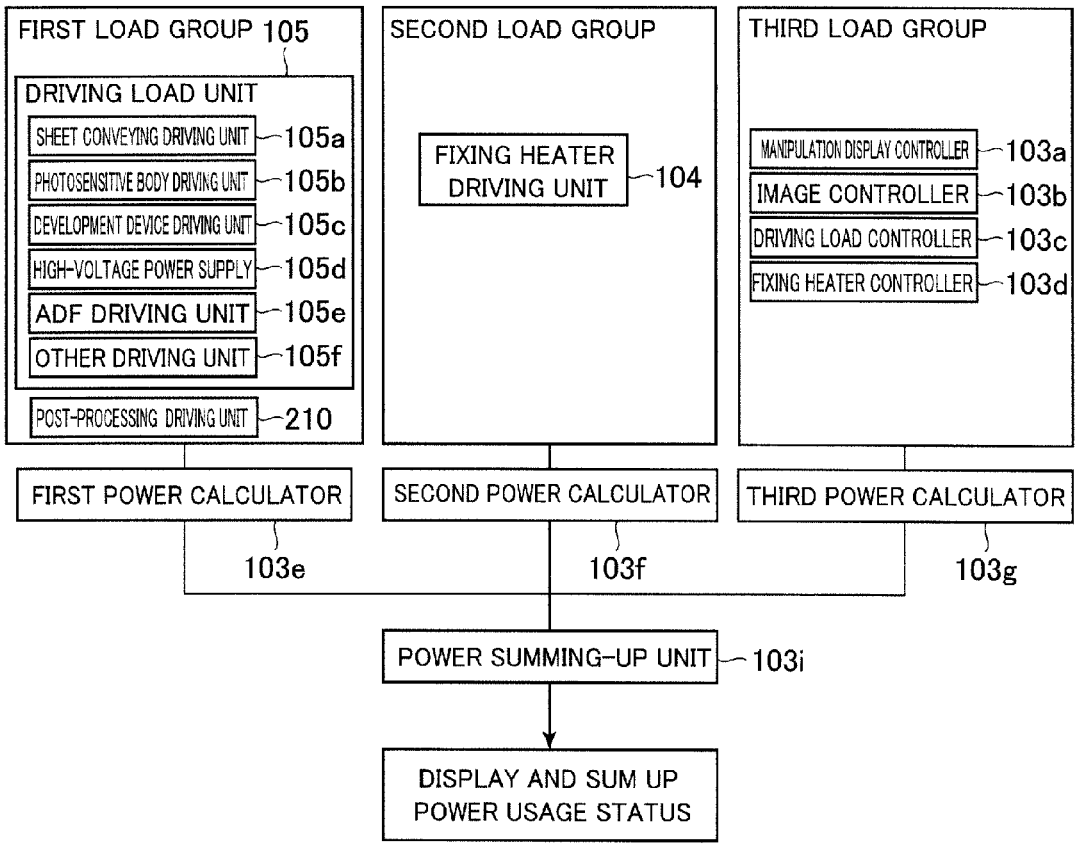
FIG. 4 is a block diagram illustrating a configuration for calculation of a power consumption amount in the image forming apparatus of the embodiment.

FIG. 4 is a block diagram illustrating a configuration for calculation of the power consumption amount in the image forming apparatus of the embodiment. FIG. 4 illustrates the configuration in which the image forming apparatus does not include post-processing device 220.

First power calculator 103*e* calculates a first load group, namely, the power consumption amounts of driving load unit 105 and post-processing device 210 based on the measured values of the currents supplied to driving load unit 105 and post-processing device 210. Specifically, first power calculator 103*e* calculates the power consumption amounts of the motors that drive the image forming apparatus based on the measured values of the currents supplied to the motors. The motors that drive the image forming apparatus include sheet conveying driving unit 105*a*, photosensitive body driving unit 105*b*, development device driving unit 105*c*, ADF driving unit 105*e*, driving unit 105*f*, and post-processing driving unit 210*b*. Additionally, first power calculator 103*e* calculates the power consumption amount of high-voltage power supply 105*d* based on the measured value of the current supplied to high-voltage power supply 105*d*. First power calculator 103*e* calculates a variable power consumption amount of a driving load system, which is operated under various conditions by the operations (the number of sheets to be printed, the sheet size, the single-sided or double-sided mode, the color or monochrome mode, the sheet feeding stage, and the post-processing mode) related to the image formation, by directly measuring the variable power consumption amount. First power calculator 103*e* may calculate the power consumption amount of the load based on at least one of the measured values of the voltage and the current, which are supplied to the load.

Second power calculator 103*f* calculates a second load group, namely, the power consumption amount of fixing heater 83 (fixing heater driving unit 104) based on the power input to fixing heater 83 and a current-carrying time of fixing heater 83. Second power calculator 103*f* predicts (calculates) the power consumption amount of fixing heater 83 in which the high power is required in a short time.

Third power calculator 103*g* calculates a third load group, namely, the total power consumption amount of manipulation display controller 103*a*, image controller 103*b*, driving load controller 103*c*, and fixing heater controller 103*d* based on the operating state and the operating time of the image forming apparatus. Third power calculator 103*g* predicts the power consumption amounts of the manipulation display controller, in which the low power is required for a long period of time, and each controller that controls the load of the control target.

Power summing-up unit 103*i* decides the power consumption amount of the whole image forming apparatus by summing up the power consumption amounts calculated by first to third power calculators 103*e* to 103*g*, and notifies display unit 102 of the decided power consumption amount. Based on the notified power consumption amount, display unit 102 displays and sums up the power usage status to inform the user of the power consumption information.

Figure 5:
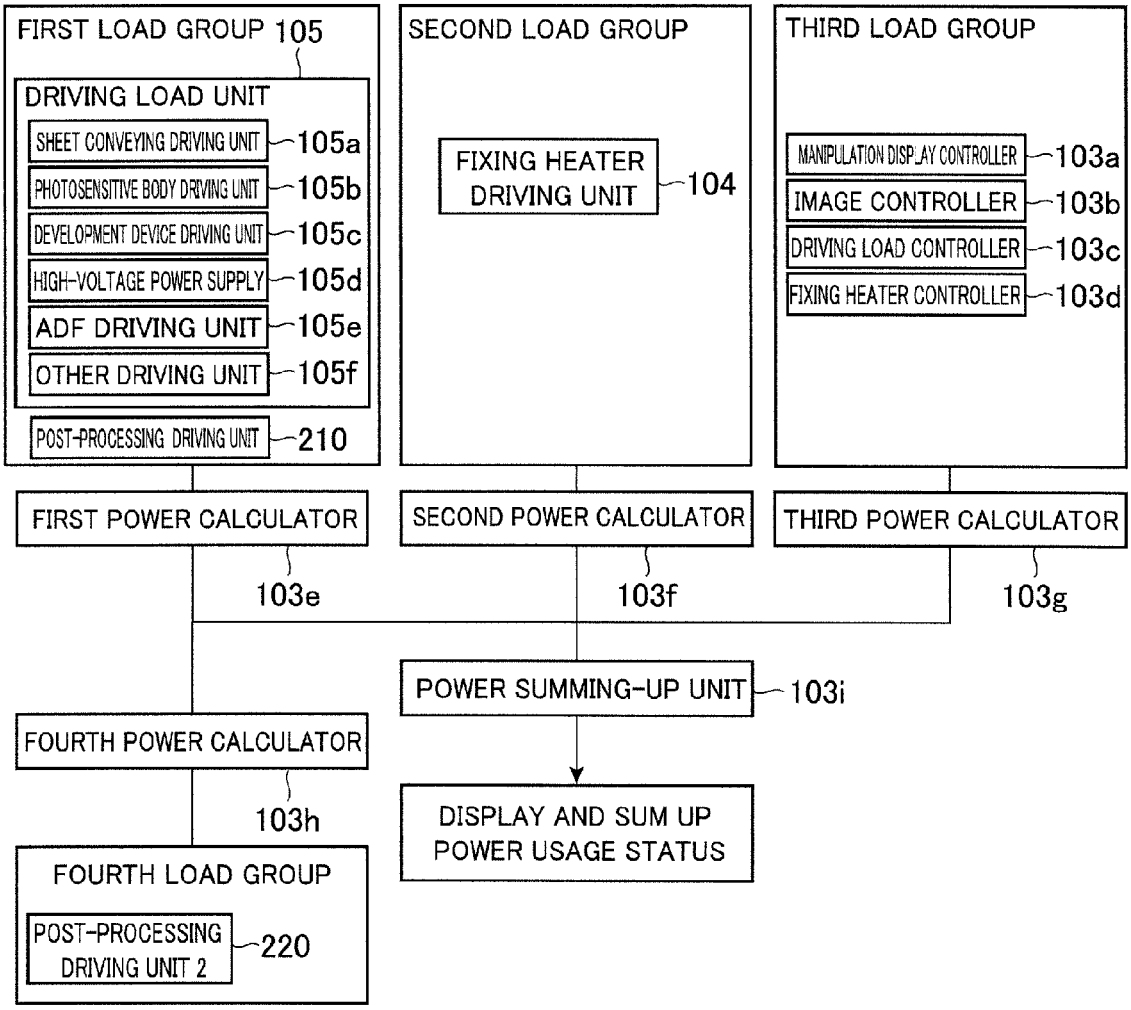
FIG. 5 is a block diagram illustrating a configuration for calculation of the power consumption amount in the image forming apparatus according to a modification of the embodiment.

FIG. 5 is a block diagram illustrating a configuration for calculation of the power consumption amount in the image forming apparatus according to a modification of the embodiment. FIG. 5 illustrates the configuration in which the power consumption of post-processing device 220 is further calculated.

Referring to FIG. 5, fourth power calculator 103*h* predicts (calculates) the power consumption of post-processing device 220, which is a fourth load group, based on the operating state and the operating time of post-processing device 220. In second peripheral devices, such as post-processing device 220, because of the generally low operating rate, the power consumption amount of the driving system load is predicted based on the operating state and the operating time of post-processing device 220.

Power summing-up unit 103*i* decides the power consumption amount of the whole image forming apparatus by summing up the power consumption amounts calculated by first to fourth power calculators 103*e* to 103*h*, and notifies display unit 102 of the decided power consumption amount. Based on the notified power consumption amount, display unit 102 displays and sums up the power usage status to inform the user of the power consumption information.

In the above power consumption amount calculating method, the easy design and the high accuracy are implemented such that the power consumption amount is calculated while divided into the portion in which the power consumption amount is obtained by the calculation and the portion in which the power consumption amount is obtained by the actual measurement according to the actual condition of the power consumption of the image forming apparatus and the temporal or durable change in power consumption.

In the case that the power consumption amount of the image forming apparatus is calculated, it is necessary to consider the comprehensive power consumption amount including not only the power consumption amount during the printing operation but also the power consumption amounts during the standby mode and the sleep mode. From this viewpoint, the power consumption amount of the image forming apparatus is preferably discussed using the power consumption amount called a TEC (Typical Electricity Consumption) value. In the TEC value, the power consumption amount is measured in the case that, the printing operation is performed with a predetermined volume, a predetermined printing operation is performed after a predetermined pause, and the power consumption amount is measured while the sleep mode is considered during a nighttime or a non-working day.

The power consumption amount constituting the TEC value is analyzed as follows.

power consumption amount in sleep mode: 29% power consumption amount (driving unit, except fixing heater) during printing: 13% power consumption amount (controller, except fixing heater) during printing: 3% power consumption amount (fixing heater) during printing: 55%

When the next printing operation is not performed after the printing operation is ended, the image forming apparatus transitions to the sleep mode (power saving mode) at a predetermined time. Because the printing operation is not performed during the nighttime and the non-working day, the image forming apparatus is in the sleep mode for a long period of time. The accumulated power consumption amount consumed in the sleep mode occupies 29% of the TEC value. In this case, because the driving load unit and the fixing heater are not operated, the power consumption amount of the whole image forming apparatus is the power consumption amount of only the controller. On the other hand, when receiving the printing instruction in the sleep mode, the image forming apparatus performs a warm-up operation, and performs the printing operation once the warm-up operation is completed. When the printing operation is ended, the image forming apparatus returns to the sleep mode. Ratios of the power consumption amounts of the driving load unit, the controller, and the fixing heater to the accumulate value of the power consumption amount of the series of operations become 13%, 3%, and 55%, respectively.

In the case that the image forming apparatus is in the sleep mode, only the minimum function of receiving the printing instruction is left while other functions pause. Therefore, the variation in power consumption decreases. Accordingly, in the case that the image forming apparatus is in the sleep mode, the power consumption amount can accurately be obtained from the operating time.

The power consumption amount of the controller during the printing is calculated based on "a image processing state depending on the printing mode" and "the operating time of the printing mode".

The power consumption amount of the driving load unit during the printing varies easily by the environment and the durability of the apparatus. Accordingly, the power consumption amount of the power supply system (in many cases, 24 V) of the driving load unit is calculated based on the measured current. Preferably the current is measured in a period synchronized with a period (a period of a main routine) in which the controller controls the operation of the motor. The controller determines whether the driving load unit should be turned on or off in each predetermined period, and the driving load unit is turned on and off according to the determination result. Accordingly, the change in current corresponds to the period.

The power consumption amount of the fixing heater during the printing is calculated based on "rated power consumption of the fixing heater" and "the operation time of the fixing heater". A difference between the rated power consumption of the fixing heater and the actual power consumption of the power consumption fixing heater is managed as a component tolerance, so that the accuracy can be managed.

At this point, when the fixing heater is turned on or off, sometimes the power consumption is gradually changed, because an inrush current is passed in a transient of the turn-on or -off of the fixing heater or the primary-side voltage varies due to the turn-on or -off of the fixing heater. In this case, the power consumption amount can correctly be calculated by adding a correction calculation to the calculation of the power consumption amount of the fixing heater. Preferably the operation time of the fixing heater is measured in synchronization with a control period in which the on and off control is performed to the fixing heater.

As described above, the power consumption amount of the driving load unit is calculated based on the measured current, and the power consumption amounts of other components are predicted based on the operating state, which allows the power consumption amount to be accurately obtained.

Figure 6:
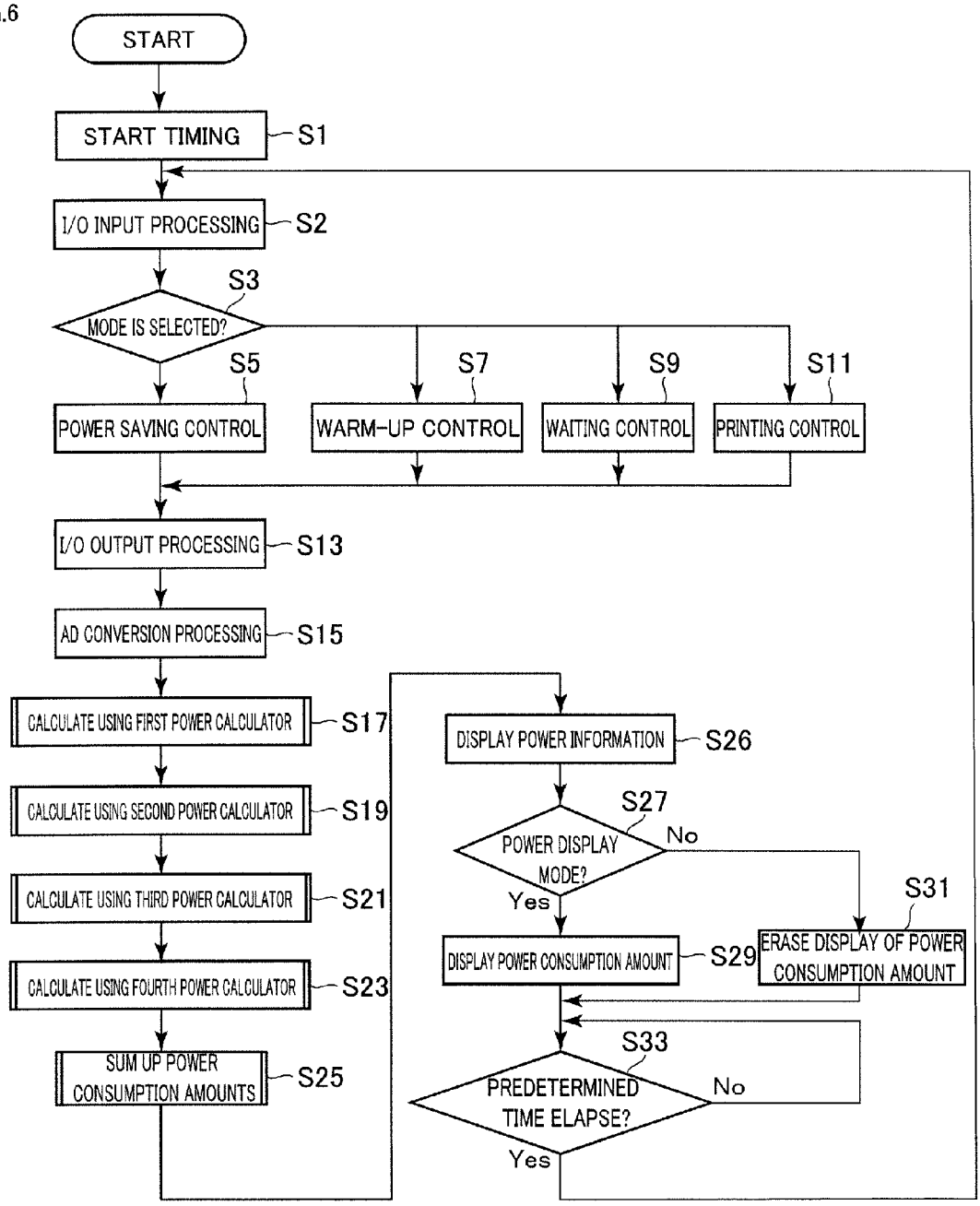
FIG. 6 is a flowchart illustrating an operation of image forming apparatus of the embodiment with respect to the calculation of the power consumption amount.

FIG. 6 is a flowchart illustrating an operation of the image forming apparatus of the embodiment with respect to the calculation of the power consumption amount. For example, the flowchart in FIG. 6 is performed such that CPU 331 of controller 103 loads the control program stored in ROM 333 of controller 103.

Referring to FIG. 6, controller 103 starts timing with a timer (S1), and performs input processing (S2). Controller 103 determines which mode is selected as an operating state of the image forming apparatus (S3).

When the power saving mode (sleep mode) is selected in step S3, controller 103 performs the power saving control (S5). Then controller 103 goes to processing in step S13. When the warm-up mode is selected in step S3, controller 103 performs the warm-up control (S7). Then controller 103 goes to the processing in step S13. When the standby mode is selected in step S3, controller 103 performs the waiting control (S9). Then controller 103 goes to the processing in step S13. When the printing mode is selected in step S3, controller 103 performs the printing control (S11). Then controller 103 goes to the processing in step S13.

Controller 103 performs the output processing (S13), and performs the AD (analog-digital) conversion processing (S15). Controller 103 performs processing of calculating the power consumption amounts of driving load unit 105 and post-processing device 210 using first power calculator 103*e* (S17). Controller 103 performs processing of calculating the power consumption amount of fixing heater 83 using second power calculator 103*f* (S19). Controller 103 performs processing of calculating a total power consumption amount of manipulation display controller 103*a*, image controller 103*b*, driving load controller 103*c*, and fixing heater controller 103*d* using third power calculator 103*g* (S21). Controller 103 performs processing of calculating the power consumption amount of post-processing device 220 using fourth power calculator 103*h* (S23). The processing in step S23 is omitted in the case that the image forming apparatus does not include post-processing device 220. Controller 103 performs processing of summing up the power consumption amounts calculated by first to fourth power calculators 103*e* to 103*h* (or first to third power calculators 103*e* to 103*g*) using power summing-up unit 103*i* (S25). Controller 103 performs power information displaying processing using display unit 102 (S26). Controller 103 determines whether a power display mode that is a mode in which the power consumption amount is displayed on display unit 102 is set through manipulation unit 101 (S27).

When the power display mode is set (Yes in S27), controller 103 displays the power consumption amount on display unit 102 (S29). Then controller 103 goes to processing in S33. On the other hand, when the power display mode is not set (No in S27), controller 103 erases the display of the power consumption amount from display unit 102 (S31). Then controller 103 goes to the processing in step S33.

Controller 103 determines whether a predetermined time (for example, 5 ms) elapses in the time measured by the timer (S33). When determining that the predetermined time elapses (Yes in S33), controller 103 goes to the processing in step S2.

Power Consumption Amount Calculating Method Performed by First Power Calculator A power consumption amount calculating method performed by first power calculator 103*e* will be described below.

Figure 7:
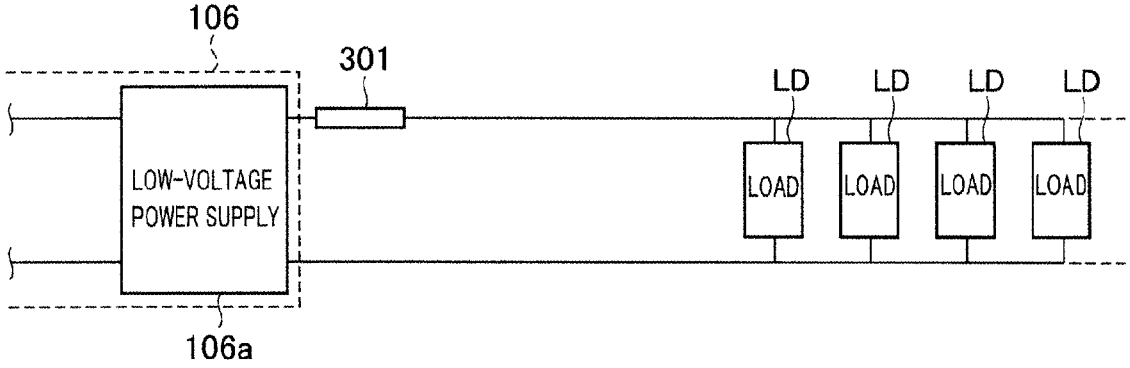
FIG. 7 is a circuit diagram illustrating a method for calculating the power consumption amounts of a driving load unit 105 and a post-processing device 210, which is performed by a first power calculator 103*e*.

FIG. 7 is a circuit diagram illustrating a method for calculating the power consumption amounts of driving load unit 105 and post-processing device 210, which is performed by first power calculator 103*e*.

Referring to FIG. 7, power supply unit 106 includes a low-voltage power supply 106*a*. In low-voltage power supply 106*a*, plural loads LD are connected in parallel to each other. Low-voltage power supply 106*a* is a rated output power supply. Low-voltage power supply 106*a* converts the primary-side (the commercial power source side of power supply unit 106) voltage into a secondary-side (the side of load LD of power supply unit 106) rated voltage (for example, 24 V), and supplies the power to each load LD at the converted voltage. Load LD is a member corresponding to each driving unit of driving load unit 105 or post-processing device 210. Current detecting resistor 301 is connected to a power supply route between low-voltage power supply 106*a* and each load LD. The total current passed through all loads LD is passed through current detecting resistor 301.

For example, first power calculator 103*e* measures (samples) a current M1(A) (an AD-converted value of a 24-V current monitor), which is an AD-converted value of the current passed through current detecting resistor 301, by the number of times N1 at time intervals T1 (s). Time interval T1 is a sampling period, and the number of times N1 is the number of sampling points. Time interval T1 and the number of times N1 are set such that a product of time interval T1 and the number of times N1 becomes 1 (s), and time interval T1 and the number of times N1 are stored, for example, in ROM 333. In the embodiment, as illustrated in FIG. 8, time interval T1 is set to 5 (ms) and the number of times N1 is set to 200 (times).

Figure 9:
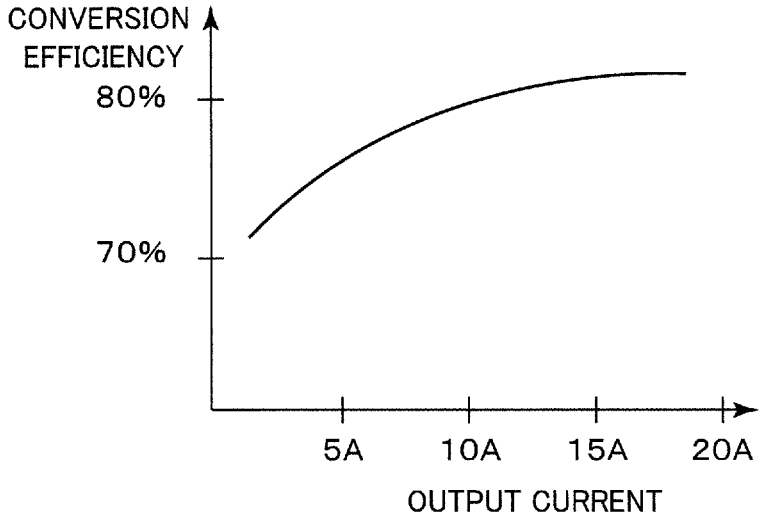
FIG. 9 is a view illustrating an example of a conversion efficiency table.

First power calculator 103*e* calculates the secondary-side power consumption amount (Ws) per second based on the measured current M1 and the secondary-side rated voltage. Because the on and off states of each load LD change complexly in a printing sequence, the current passed through current detecting resistor 301 is measured, and the secondary-side power consumption amount is calculated based on the measured current, thereby improving the accuracy of the power consumption amount. Preferably first power calculator 103*e* converts the secondary-side power consumption amount into the primary-side power consumption amount (Ws). This is because conversion efficiency varies according to the current (the secondary-side current) in low-voltage power supply 106*a*. In the case that the secondary-side power consumption amount is converted into the primary-side power consumption amount, for example, a conversion efficiency table in FIG. 9 is preferably used. Then first power calculator 103*e* notifies power summing-up unit 103*i* of the calculation information.

Figure 10:
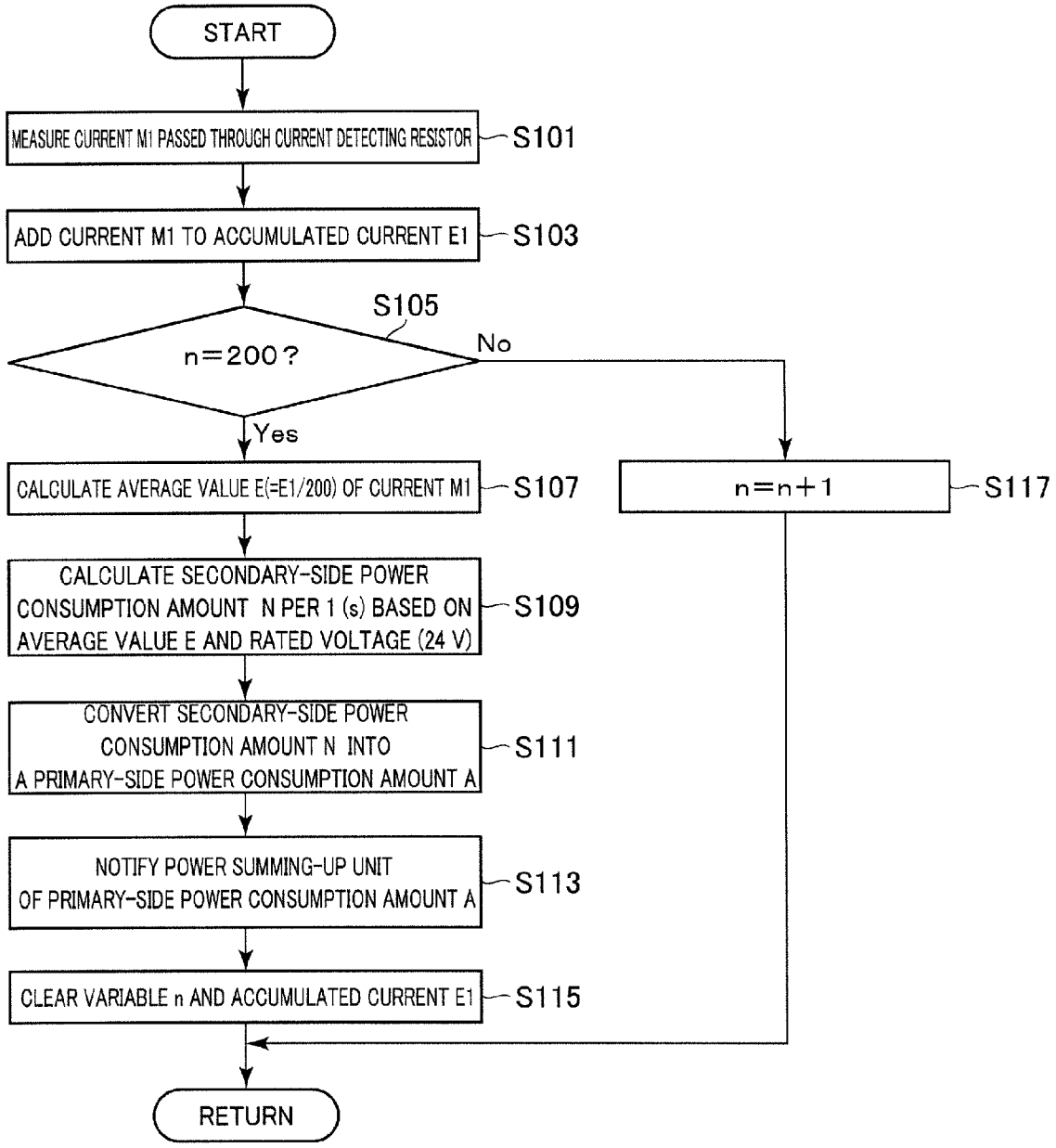
FIG. 10 is a flowchart illustrating a power consumption amount calculating processing performed by first power calculator 103*e*.

FIG. 10 is a flowchart illustrating the power consumption amount calculating processing performed by first power calculator 103*e*. The flowchart in FIG. 10 is performed as a subroutine of the processing in step S17 in FIG. 6.

Referring to FIG. 10, first power calculator 103*e* measures current M1 passed through current detecting resistor 301 (S101), and adds current M1 to accumulated current E1

(S103). First power calculator 103*e* determines whether a variable n reaches 200 (the time of 1 (s) elapses) (S105).

When determining that variable n reaches 200 (Yes in S105), first power calculator 103*e* divides accumulated current E1 by 200 to calculate an average value E of the current M1 in 1 (s) (S107). First power calculator 103*e* calculates a secondary-side power consumption amount N per 1 (s) based on average value E and the rated voltage (24 V) (S109). First power calculator 103*e* converts secondary-side power consumption amount N into a primary-side power consumption amount A per 1 (s) (S111). In step S111, for example, the conversion efficiency is obtained using the conversion efficiency table in FIG. 9 in the case that the current is average value E, and secondary-side power consumption amount N is divided by the obtained conversion efficiency to calculate primary-side power consumption amount A. First power calculator 103*e* notifies power summing-up unit 103*i* of primary-side power consumption amount A (S113), and clears variable n and accumulated current E1 (S115). Then first power calculator 103*e* returns to the processing in step S17 in FIG. 6.

When variable n does not reach 200 (No in S105), first power calculator 103*e* increments variable n (S117). Then first power calculator 103*e* returns to the processing in step S17 in FIG. 6.

Power Consumption Amount Calculating Method Performed by Second Power Calculator A power consumption amount calculating method, which is performed by second power calculator 103*f* in the case that fixing device 8 is a halogen fixing device (in the case that fixing heater 83 is a halogen heater), will be described below.

In the case that fixing device 8 is the halogen fixing device in which the halogen heater (a halogen lamp) is used, it is necessary that a warm-up time satisfy a predetermined condition (product specification) while the current passed through fixing heater 83 is suppressed to a rated current (for example, 15 A or 20 A) or less. Therefore, the actual power consumption for the rated power in fixing heater 83 (copying machine halogen heater) or the heat quantity generated by fixing heater 83 is strictly managed. Therefore, the variation in power consumption is decreased in the case that fixing heater 83 is in the on state. When attention is paid to this fact, the power consumption amount of fixing heater 83 that is the halogen fixing device can correctly be calculated based on the rated power and the current-carrying time of fixing heater 83.

Figure 11:
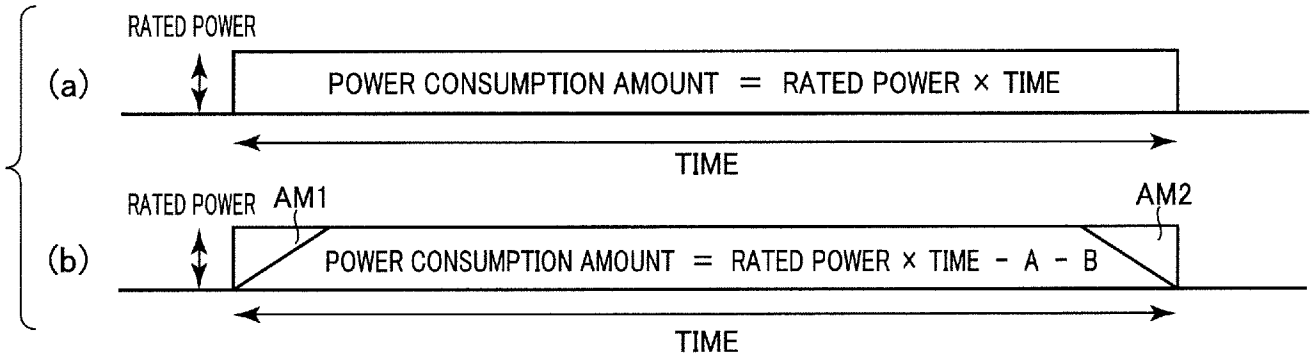
FIG. 11 is a conceptual view illustrating a method for calculating the power consumption amount of a fixing heater 83, which is performed by a second power calculator 103*f*, in the case that a fixing device 8 is a halogen fixing device.

FIG. 11 is a conceptual view illustrating the method for calculating the power consumption amount of fixing heater 83, which is performed by second power calculator 103*f*, in the case that fixing device 8 is the halogen fixing device.

Referring to FIG. 11(*a*), in the case that the normal control is performed to fixing device 8, second power calculator 103*f* calculates the power consumption amount of fixing heater 83 by a product of the rated power and the current-carrying time of fixing heater 83 with the rated power of fixing heater 83 as the power input to fixing heater 83. On the other hand, in the case that the fixing heater is turned on or off, sometimes control (through-up control) in which the current passed through fixing heater 83 is gently increased or control (through-down control) in which the current passed through fixing heater 83 is gently decreased is performed in order to prevent a damage of fixing heater 83 due to the inrush current. In the case that the above control is performed, as illustrated in FIG. 11(*b*), second power calculator 103*f* corrects the power consumption amount based on the change in power consumption of fixing heater 83 in the transient states immediately after the start of the operation and immediately before the stop of the operation. Specifically, second power calculator 103*f* calculates the power consumption amount of fixing heater 83 by subtracting a corrected power consumption amount AM1 in the through-up control and a corrected power consumption amount AM2 in the through-down control from the product of the rated power and the current-carrying time of fixing heater 83.

Second power calculator 103*f* may correct the power consumption based only on one of the transient states immediately after the start of the operation and immediately before the stop of the operation.

An example of the method for calculating the power consumption amount of fixing heater 83 will be described below in the case that fixing heater 83 includes two halogen heaters, namely, a long heater and a short heater. As illustrated in FIG. 12, it is assumed that the rated powers of the long heater and the short heater are 1180 (W) and 790 (W), respectively.

Figure 13:
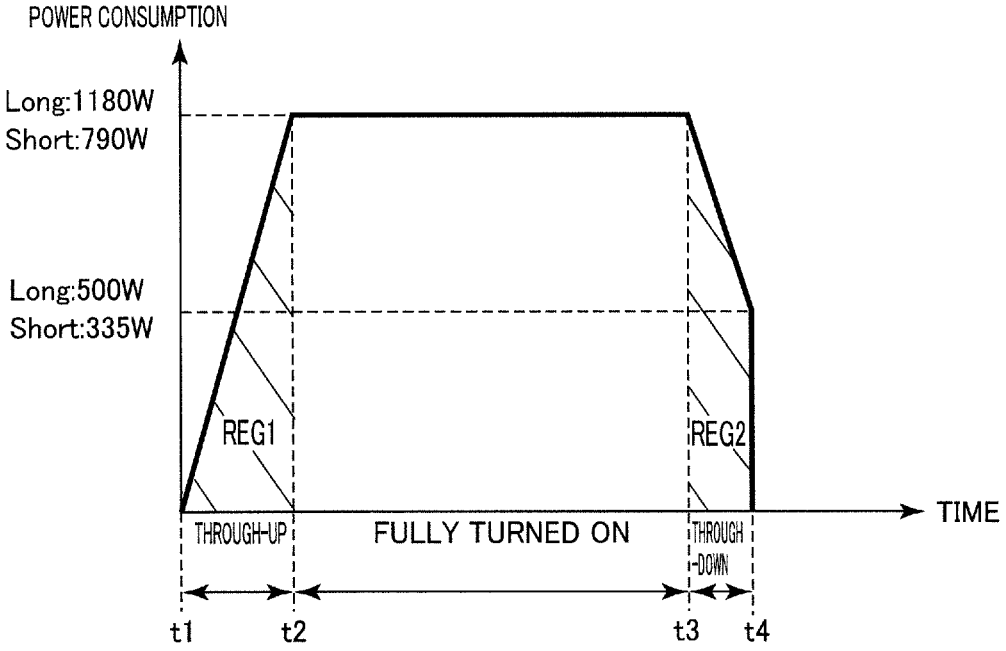
FIG. 13 is a view illustrating a typical turn-on pattern of the fixing device 8.

FIG. 13 is a view illustrating a typical turn-on pattern of fixing device 8.

Referring to FIG. 13, in the case that fixing heater 83 is turned on at a clock time t1, the power consumption of fixing heater 83 increases to the rated power in proportion to the time by the through-up control. When the power consumption of fixing heater 83 increases to the rated power at a clock time t2, fixing heater 83 is fully turned on, and the power consumption becomes constant. When fixing heater 83 is turned off at a clock time t3, the power consumption of fixing heater 83 decreases to off-state power consumption in proportion to the time by the through-down control. The off-state power consumption is 500 (W) in the long heater, and the off-state power consumption is 335 (W) in the short heater. When the power consumption of fixing heater 83 decreases to the off-state power consumption at a clock time t4, fixing heater 83 is fully turned off.

In the case that fixing device 8 is the halogen fixing device, second power calculator 103*f* samples a phase control state of fixing heater 83 by the number of times N2 at time intervals T2 while measuring an elapsed time in the case that fixing heater 83 is in the phase control state. Time interval T2 is the sampling period, and the number of times N2 is the number of sampling points. Time interval T2 and the number of times N2 are set such that the product of time interval T2 and the number of times N2 becomes 1 (s), and time interval T2 and the number of times N2 are stored, for example, in ROM 333. In the embodiment, time interval T2 is set to 5 (ms) and the number of times N2 is set to 200 (times). As used herein, the phase control state of fixing heater 83 means a fully turned-on state, a fully turned-off state, a through-up control state, and a through-down control state of fixing heater 83, for example. In the case that the phase control state is switched, second power calculator 103*f* calculates the power consumption amount (Ws) per 1 (s) of fixing heater 83 based on the kind of the preceding-switching phase control state and the elapsed time of the preceding-switching phase control state. Then second power calculator 103*f* notifies power summing-up unit 103*i* of the calculation information, and measures the elapsed time of the elapsed time of the post-switching phase control state again.

FIG. 14 is a table schematically illustrating a relationship between the phase control state and a calculation formula of the power consumption amount. FIG. 15 is a table schematically illustrating the calculation formula in FIG. 14.

Referring to FIG. 14, in the case that the phase control state is the through-up control state, a calculation formula indicated in a field of "A-1" in FIG. 15 is used in the long heater, and a calculation formula indicated in a field of "A-2" in FIG.

15 is used in the short heater. In the case that the phase control state is the through-down control state, a calculation formula indicated in a field of "A-3" in FIG. 15 is used in the long heater, and a calculation formula indicated in a field of "A-4" in FIG. 15 is used in the short heater. In the case that the phase control state is the fully turned-on state, a calculation formula indicated in a field of "A-5" in FIG. 15 is used in the long heater, and a calculation formula indicated in a field of "A-6" in FIG. 15 is used in the short heater.

Referring to FIG. 15, because the power consumption of fixing heater 83 increases in proportion to the time in the through-up control state, in the calculation formulae indicated in the fields "A-1" and "A-2", the power consumption amount is calculated as a triangular area of a region REG1 indicated by an oblique line in FIG. 13. Because the power consumption of fixing heater 83 decreases in proportion to the time in the through-down control state, in the calculation formulae indicated in the fields "A-3" and "A-4", the power consumption amount is calculated as a trapezoidal area of a region REG2 indicated by an oblique line in FIG. 13.

Figure 16:
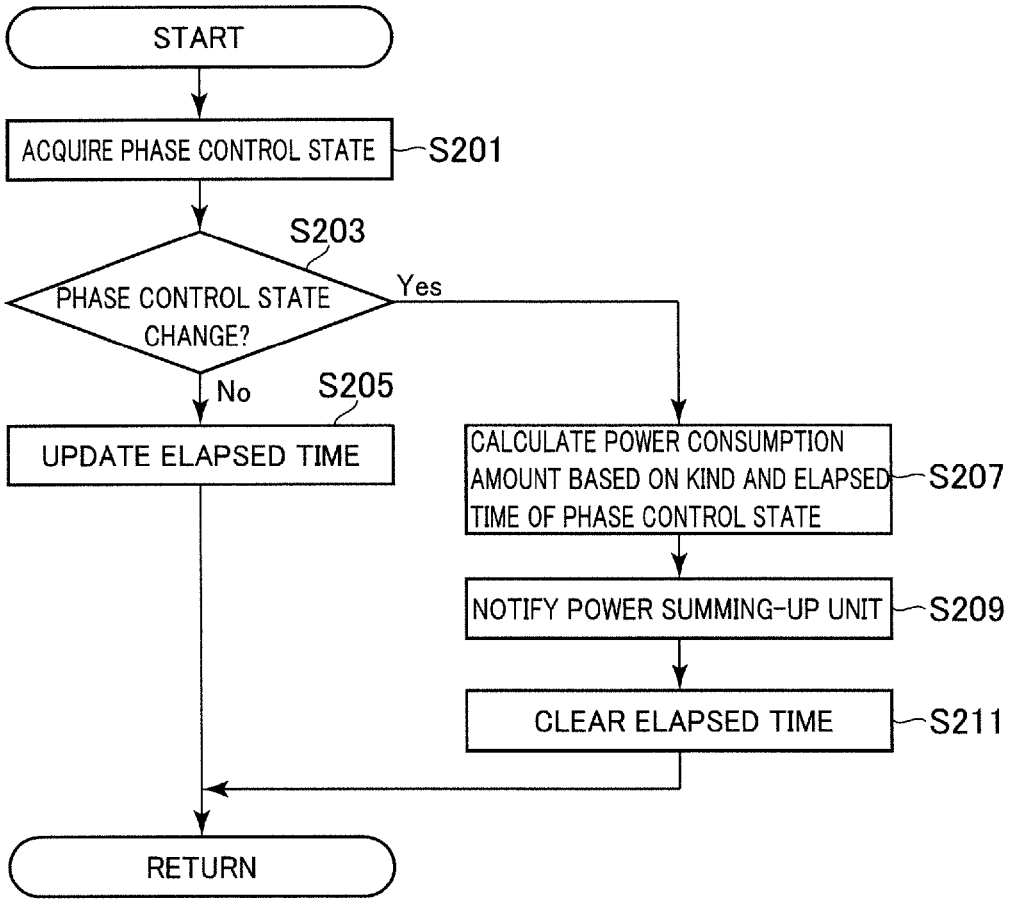
FIG. 16 is a flowchart illustrating power consumption amount calculating processing performed by second power calculator 103*f* in the case that the fixing device 8 is a halogen fixing device.

FIG. 16 is a flowchart illustrating the power consumption amount calculating processing performed by second power calculator 103*f* in the case that fixing device 8 is the halogen fixing device. The flowchart in FIG. 16 is performed as a subroutine of the processing in step S19 in FIG. 6.

Referring to FIG. 16, second power calculator 103*f* acquires the phase control state of fixing heater 83 from fixing heater 83 (S201), and determines whether the phase control state changes (S203).

When determining that the phase control state does not change (No in S205), second power calculator 103*f* updates the elapsed time (S205). Then second power calculator 103*f* returns to the processing in step S19 in FIG. 6. On the other hand, when determining that the phase control state changes (Yes in S203), the power consumption amount of fixing heater 83 is calculated based on the kind and the elapsed time of the phase control state (S207). Second power calculator 103*f* notifies power summing-up unit 103*i* of the power consumption amount of fixing heater 83 (S209), and clears the elapsed time (S211). Then second power calculator 103*f* returns to the processing in step S19 in FIG. 6.

A power consumption amount calculating method, which is performed by second power calculator 103*f* in the case that fixing device 8 is an IH (induction heating) fixing device (in the case that fixing heater 83 is an IH heater), will be described below.

Figure 17:
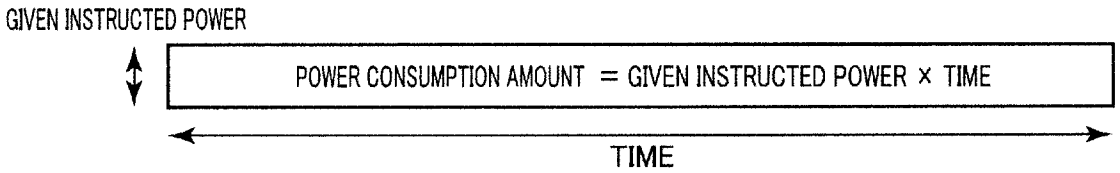
FIG. 17 is a conceptual view illustrating the method for calculating the power consumption amount of fixing heater 83, which is performed by second power calculator 103*f*, in the case that the fixing device 8 is an IH fixing device.

FIG. 17 is a conceptual view illustrating the method for calculating the power consumption amount of fixing heater 83, which is performed by second power calculator 103*f*, in the case that fixing device 8 is the IH fixing device.

Referring to FIG. 17, in the case that fixing device 8 is the IH fixing device, fixing device 8 includes an IH coil and an IH power supply that supplies the power to the IH coil. Controller 103 supplies a given instructed power to the IH power supply, and performs the on and off control of the IH power supply.

Accordingly, in the case that fixing device 8 is the IH fixing device, the power consumption amount of fixing heater 83 can correctly be calculated based on the instructed power supplied by controller 103 and the current-carrying time of fixing heater 83 as illustrated in FIG. 17. In the case that a heater relay switch is turned off in a sampling period of the instructed power, the sampled instructed power does not change although fixing heater 83 is brought into the off state.

In the case that fixing device 8 is the IH fixing device, second power calculator 103*f* samples the instructed power (W), which is supplied to fixing heater 83 by controller 103, by the number of times N2 at time intervals T2. Time interval T2 is the sampling period, and the number of times N2 is the number of sampling points. Time interval T2 and the number of times N2 are set such that the product of time interval T2 and the number of times N2 becomes 1 (s), and time interval T2 and the number of times N2 are stored, for example, in ROM 333. In the embodiment, as illustrated in FIG. 18, time interval T2 is set to 100 (ms) and the number of times N2 is set to 10 (times). Second power calculator 103*f* calculates an average value H of the instructed powers (W), which are sampled 10 times, as the power consumption amount (Ws) per 1 (s) of fixing heater 83. Second power calculator 103*f* notifies power summing-up unit 103*i* of the calculation information.

Second power calculator 103*f* may calculate the power consumption amount (Ws) per 1 (s) of fixing heater 83 by multiplying average value H of the instructed powers (W), which are sampled 10 times, by a voltage drop correction coefficient R1 as indicated by the following equation (1). In the embodiment, as illustrated in FIG. 18, voltage drop correction coefficient R1 is set to 1.03.

$$\text{power consumption amount } (Ws) \text{ per } 1(s) \text{ of fixing heater } 83 = \text{average value } H \times \text{voltage drop correction coefficient } R1 \quad (1)$$

Figure 19:
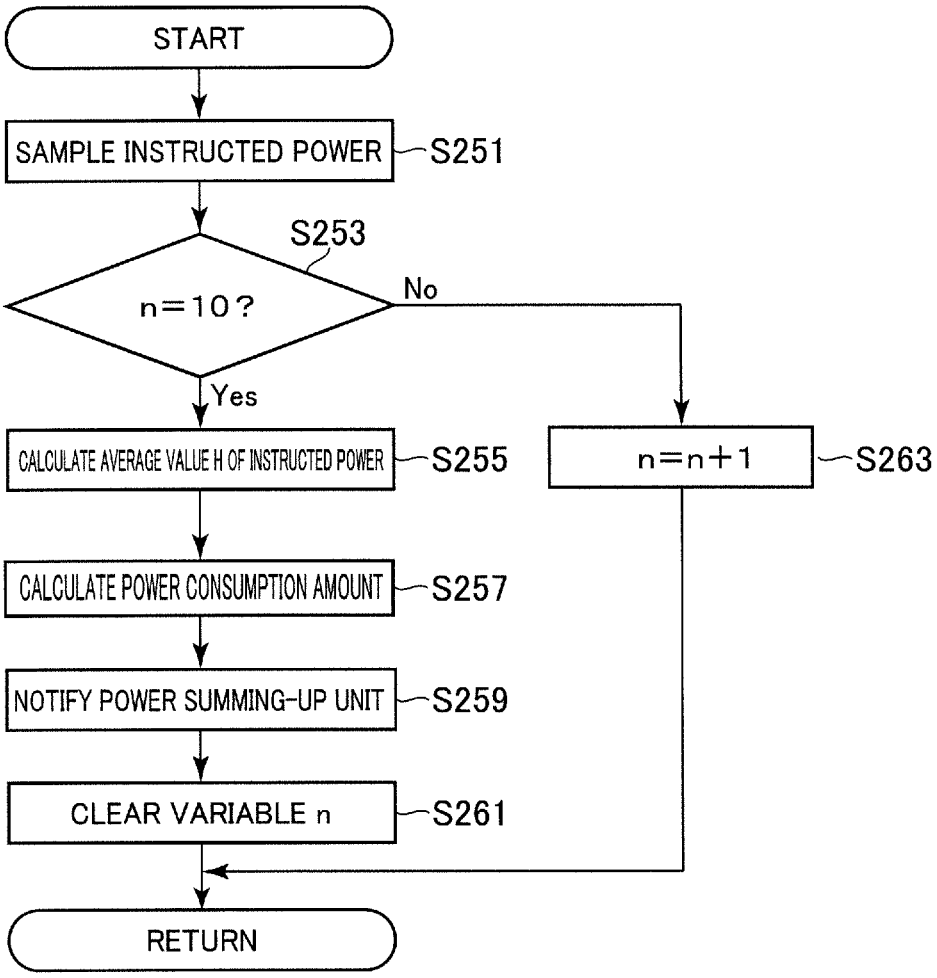
FIG. 19 is a flowchart illustrating the power consumption amount calculating processing performed by second power calculator 103*f* in the case that the fixing device 8 is the IH fixing device.

FIG. 19 is a flowchart illustrating the power consumption amount calculating processing performed by second power calculator 103*f* in the case that fixing device 8 is the IH fixing device. The flowchart in FIG. 19 is performed as the subroutine of the processing in step S19 in FIG. 6.

Referring to FIG. 19, second power calculator 103*f* samples the instructed power of fixing heater 83 (S251), and determines whether variable n reaches 10 (whether the time of 1 (s) elapses) (S253).

When determining that variable n reaches 10 (Yes in S253), second power calculator 103*f* calculates average value H of the instructed power, which are sampled 10 times (S255), and calculates the power consumption amount of fixing heater 83 using the equation (1) (S257). Second power calculator 103*f* notifies power summing-up unit 103*i* of the power consumption amount of fixing heater 83 (S259), and clears variable n (S261). Then second power calculator 103*f* returns to the processing in step S19 in FIG. 6.

When determining that variable n does not reach 10 (No in S253), second power calculator 103*f* increments variable n (S263). Then first power calculator 103*e* returns to the processing in step S19 in FIG. 6.

Power Consumption Amount Calculating Method Performed by Third Power Calculator A power consumption amount calculating method performed by third power calculator 103*g* will be described below.

When manipulation display controller 103*a*, image controller 103*b*, driving load controller 103*c*, and fixing heater controller 103*d* have the small power consumption and the same operating state of the image forming apparatus, these controllers have the small variation in power consumption. Accordingly, third power calculator 103*g* calculates the total power consumption amount of manipulation display controller 103*a*, image controller 103*b*, driving load controller 103*c*, and fixing heater controller 103*d* based on the power consumption amount per unit time, which is predicted from the operating state of the image forming apparatus, and the operating time.

FIG. 20 is a table illustrating a correspondence relationship between the operating state of the image forming apparatus and a power consumption parameter P. For example, the table in FIG. 20 is stored, for example, in ROM 333.

Referring to FIG. 20, power consumption parameter P is a value indicating the total power consumption amount (Ws) of manipulation display controller 103*a*, image controller 103*b*, driving load controller 103*c*, and fixing heater controller 103*d* in the time corresponding to the sampling period (0.1 (s)). Power consumption parameter P is set according to each of the operating states of the warm-up state, the power saving state, the standby state, and the printing state.

The warm-up state means a state in which the image forming apparatus currently performs a predetermined preparation operation in order to transition from the power saving state or the power-supply off state to the state in which the printing can be performed. The preparation operation includes an operation to rise the temperature of fixing device 8 using fixing heater 83 and other operations. In the case that the image data is received to transition to the warm-up state, the image forming apparatus transitions to the printing state after the preparation operation is completed. In the case that the transition is made to the warm-up state in the power-supply on state, the image forming apparatus transitions to the standby state after the preparation operation is completed. In the case that the image forming apparatus is in the warm-up state, a value P1 is set as power consumption parameter P.

The power saving state (sleep mode) means a state in which some power supplies of the image forming apparatus are turned off. In the case that the image forming apparatus is in the power saving state, a value P2 is set as power consumption parameter P.

The standby state means a state in which the printing can immediately be started once the image data is received. In the case that the image forming apparatus is in the standby state, a value P3 is set as power consumption parameter P.

The printing state means a state in which the image forming operation is currently performed based on the image data. In the case that the image forming apparatus is in the printing state, a value P4 is set as power consumption parameter P.

Third power calculator 103*g* measures (samples) power consumption parameter P corresponding to the current operating state of the image forming apparatus by the number of times N3 at time intervals T3 (s). Time interval T3 is the sampling period, and the number of times N3 is the number of sampling points. Time interval T3 and the number of times N3 are set such that the product of time interval T3 and the number of times N3 becomes 1 (s). In the embodiment, time interval T3 is set to 100 (ms) and the number of times N3 is set to 10 (times).

Third power calculator 103*g* calculates the secondary-side power consumption amount (Ws) per 1 (s) by accumulating 10 sampled power consumption parameters P. Preferably third power calculator 103*g* converts the secondary-side power consumption amount into the primary-side power consumption amount (Ws). This is because the conversion efficiency varies according to the current (the secondary-side current) in low-voltage power supply 106*a*. In the case that the secondary-side power consumption amount is converted into the primary-side power consumption amount, for example, the conversion efficiency table in FIG. 9 is preferably used. Then third power calculator 103*g* notifies power summing-up unit 103*i* of the calculation information.

Figure 21:
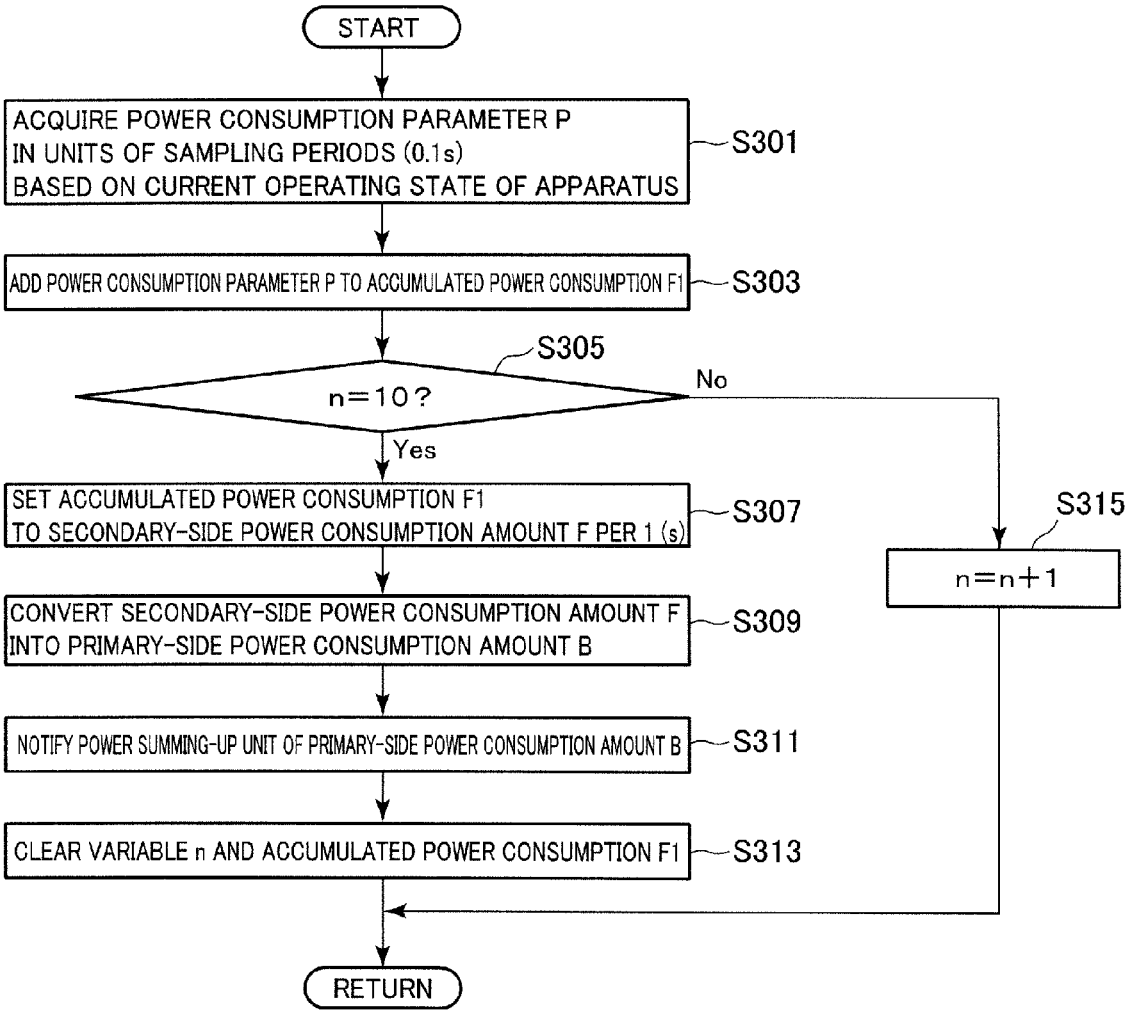
FIG. 21 is a flowchart illustrating a power consumption amount calculating processing performed by a third power calculator 103*g*.

FIG. 21 is a flowchart illustrating the power consumption amount calculating processing performed by third power calculator 103*g*. The flowchart in FIG. 21 is performed as a subroutine of the processing in step S21 in FIG. 6.

Referring to FIG. 21, third power calculator 103*g* acquires power consumption parameter P in units of sampling periods from the table in FIG. 20 based on the current operating state of the image forming apparatus (S301), and adds power consumption parameter P to accumulated power consumption F1 (S303). Third power calculator 103*g* determines whether variable n reaches 10 (the time of 1 (s) elapses) (S305).

When determining that variable n reaches 10 (Yes in S305), third power calculator 103*g* sets accumulated power consumption F1 to a secondary-side power consumption amount F per 1 (s) (S307), and converts the secondary-side power consumption amount F into a primary-side power consumption amount B (S309). In step S309, for example, the conversion efficiency is obtained using the conversion efficiency table in FIG. 9 in the case of the current corresponding to secondary-side power consumption amount F, and secondary-side power consumption amount F is divided by the obtained conversion efficiency to calculate primary-side power consumption amount B. Third power calculator 103*g* notifies power summing-up unit 103*i* of primary-side power consumption amount B (S311), and clears variable n and accumulated power consumption F1 (S313). Then power calculator 103*g* returns to the processing in step S21 in FIG. 6.

When determining that variable n does not reach 10 (No in S305), third power calculator 103*g* increments variable n (S315). Then power calculator 103*g* returns to the processing in step S21 in FIG. 6.

Power Consumption Amount Calculating Method Performed by Fourth Power Calculator A power consumption amount calculating method performed by fourth power calculator 103*h* will be described below.

In the case that post-processing device 220 does not perform the sheet feeding operation, the variation in power consumption of post-processing device 220 decreases when the image forming apparatus is maintained in the same operating state. On the other hand, in the case that post-processing device 220 performs the sheet feeding operation, the power consumption of post-processing device 220 increases according to the number of fed sheets. Accordingly, fourth power calculator 103*h* calculates the power consumption of post-processing device 220 based on the power consumption per unit time, which is predicted from the operating state of the image forming apparatus, the operating time, and the number of sheets fed by post-processing device 220.

FIG. 22 is a table illustrating a correspondence relationship between the operating state of the image forming apparatus and a power consumption parameter Q. For example, the table in FIG. 22 is stored, for example, in ROM 333.

Referring to FIG. 22, power consumption parameter Q is a value indicating the power consumption amount (Ws) of post-processing device 220 for the time corresponding to the sampling period (0.1 (s)) in the case that post-processing device 220 performs the sheet feeding operation. Power consumption parameter Q is set according to the case that warm-up state, power saving state, standby state or the printing state in which the page inserting mode is not selected, and printing state in which the page inserting mode is selected.

In the case that the image forming apparatus is in the warm-up state, a value Q1 is set as power consumption parameter Q. In the case that the image forming apparatus is in the power saving state, a value Q2 is set as power consumption parameter Q. In the case that the image forming apparatus is in the standby state, or in the case that the page inserting mode is not selected while the image forming apparatus is in the standby state, a value Q3 is set as power consumption parameter Q. In the case that the page inserting mode is selected while the image forming apparatus is in the printing state, a value Q4 is set as power consumption parameter Q. In the case that the page inserting mode is selected, because post-processing device 220 performs the page inserting operation, power consumption parameter Q depends on the existence or non-existence of the selection of the page inserting mode.

Fourth power calculator 103*h* measures (samples) power consumption parameter Q corresponding to the current operating state of the image forming apparatus by the number of times N4 at time intervals T4 (s). Time interval T4 is the sampling period, and the number of times N4 is the number of sampling points. Time interval T4 and the number of times N4 are set such that the product of time interval T4 and the number of times N4 becomes 1 (s), and time interval T4 and the number of times N4 are stored, for example, in ROM 333. In the embodiment, time interval T4 is set to 100 (ms) and the number of times N4 is set to 10 (times). Fourth power calculator 103*h* calculates the power consumption amount (Ws), except the sheet feeding operation, per 1 (s) of post-processing device 220 by accumulating 10 sampled power consumption parameters Q.

Fourth power calculator 103*h* counts the number of sheets fed by post-processing device 220, and fourth power calculator 103*h* calculates the power consumption amount (Ws), related to the sheet feeding operation, per 1 (s) of post-processing device 220 by multiplying the number of counted sheets and a power consumption amount R (Ws) necessary to feed one sheet. Power consumption amount R is a previously-set parameter, and stored in ROM 333.

Then fourth power calculator 103*h* calculates the power consumption amount (Ws) per 1 (s) of post-processing device 220 by adding the power consumption amount (Ws), related to the sheet feeding operation, per 1 (s) of post-processing device 220 to the power consumption amount (Ws), except the sheet feeding operation, per 1 (s) of post-processing device 220.

Figure 23:
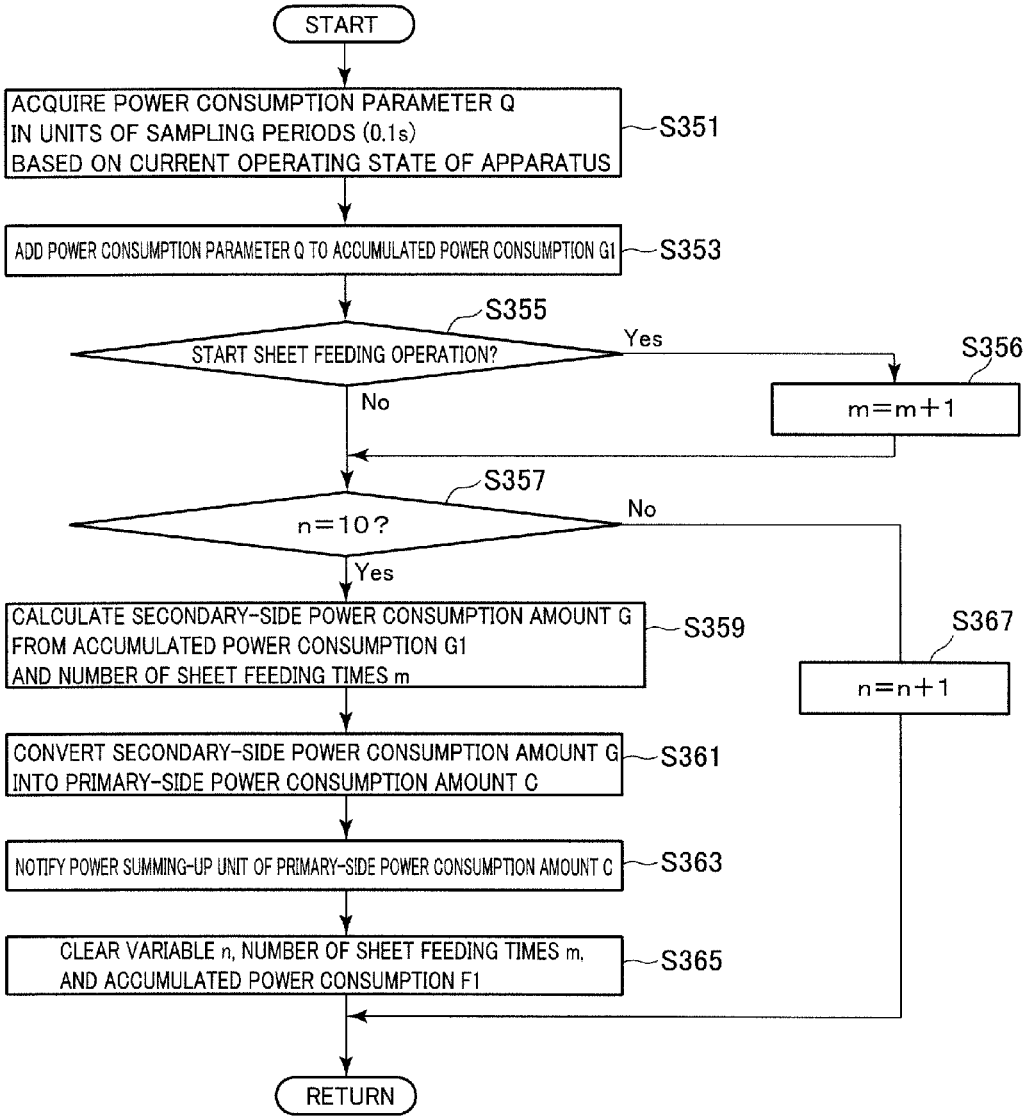
FIG. 23 is a flowchart illustrating a power consumption amount calculating processing performed by a fourth power calculator 103*h*.

FIG. 23 is a flowchart illustrating the power consumption amount calculating processing performed by fourth power calculator 103*h*. The flowchart in FIG. 23 is performed as a subroutine of the processing in step S23 in FIG. 6.

Referring to FIG. 23, fourth power calculator 103*h* acquires power consumption parameter Q in units of sampling periods from the table in FIG. 22 based on the current operating state of the image forming apparatus (S351), and adds power consumption parameter Q to accumulated power consumption G1 (S353). Fourth power calculator 103*h* determines whether post-processing device 220 starts the sheet feeding operation (S355).

When determining that post-processing device 220 starts the sheet feeding operation (Yes in S355), fourth power calculator 103*h* increments the number of sheet feeding times m by 1, and goes to processing in step S357. On the other hand, when determining that post-processing device 220 does not start the sheet feeding operation (No in S355), fourth power calculator 103*h* goes to the processing in step S357.

Fourth power calculator 103*h* determines whether variable n reaches 10 (the time of 1 (s) elapses) (S357). When variable n reaches 10 (Yes in S357), fourth power calculator 103*h* calculates a secondary-side power consumption amount G per 1 (s) from accumulated power consumption G1 and the number of sheet feeding times m (S359). In step S359, secondary-side power consumption amount G is calculated using the following equation (2).

secondary-side power consumption amount $G(Ws)$=accumulated power consumption $G1$+the number of sheet feeding times $m$×power consumption amount $R$ necessary to feed one sheet (2)

Fourth power calculator 103*h* converts secondary-side power consumption amount G into a primary-side power consumption amount C (S361). In step S361, for example, the conversion efficiency is obtained using the conversion efficiency table in FIG. 9 in the case of the current corresponding to secondary-side power consumption amount G, and secondary-side power consumption amount G is divided by the obtained conversion efficiency to calculate primary-side power consumption amount C. Fourth power calculator 103*h* notifies power summing-up unit 103*i* of primary-side power consumption amount C (S363), and clears variable n, the number of sheet feeding times m, and the value of accumulated power consumption G1 (S365). Then fourth power calculator 103*h* returns to the processing in step S23 in FIG. 6.

When determining that variable n does not reach 10 (No in S357), fourth power calculator 103*h* increments variable n (S367). Then fourth power calculator 103*h* returns to the processing in step S23 in FIG. 6.

Power Summing-Up Processing Performed by Power Summing-Up Unit

Then the power summing-up processing performed by power summing-up unit 103*i* will be described.

When receiving the notification of the information on the power consumption amount from each of first to fourth power calculators 103*e* to 103*h* (or first to third power calculators 103*e* to 103*g*), power summing-up unit 103*i* accumulates the total power consumption amount of first to fourth load groups (or first to third load groups), and stores the accumulated value in a memory (for example, the nonvolatile RAM in ROM 333). Power summing-up unit 103*i* notifies manipulation display controller 103*a* of the accumulated value as power amount information at a predetermined power amount notifying time (a constant period time or time in which the operating state of the image forming apparatus changes). For example, the predetermined power amount notifying time is set to 5 (s). After the notification, power summing-up unit 103*i* clears the total value of the power consumption amounts stored in the memory.

Figure 24:
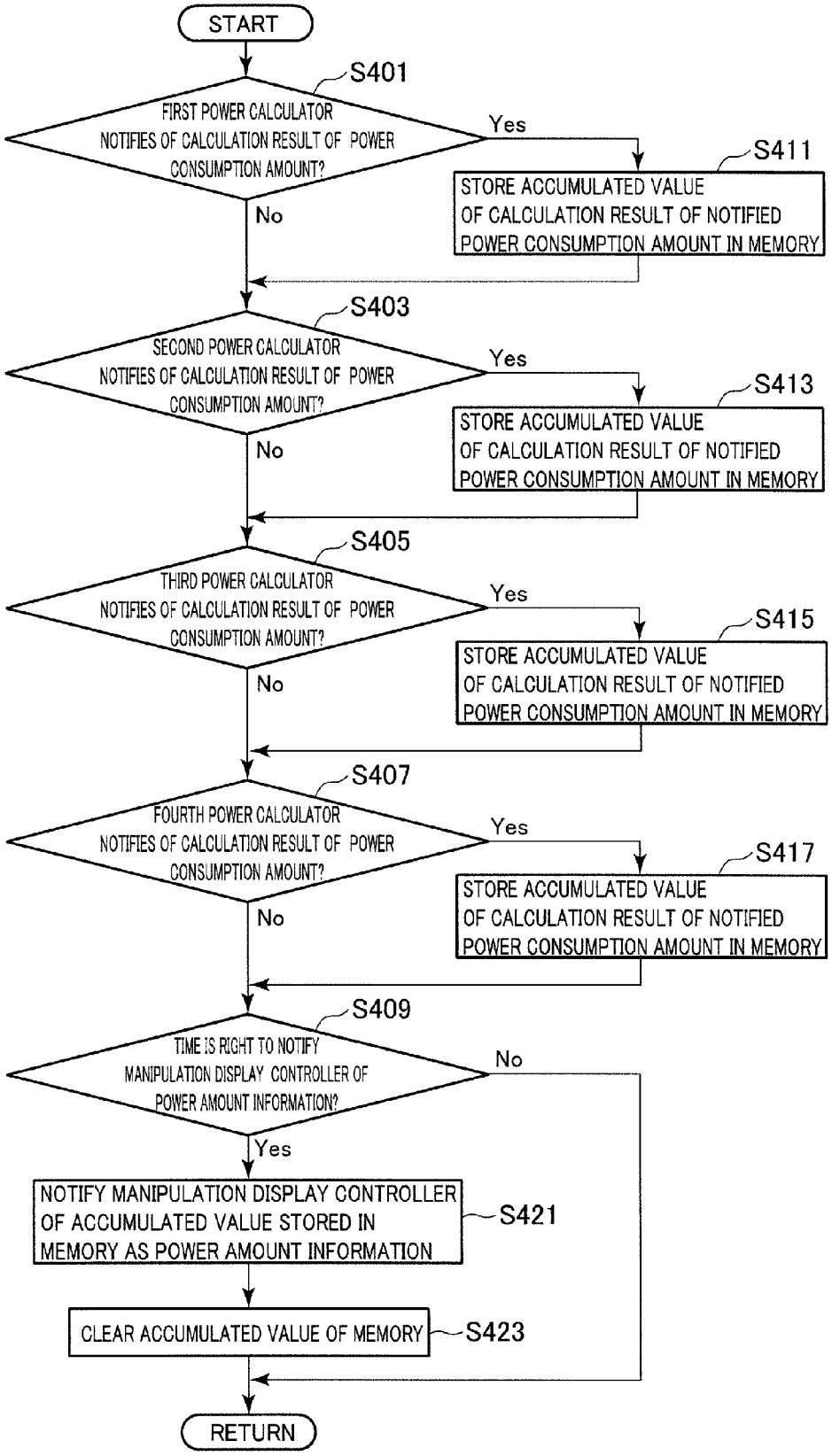
FIG. 24 is a flowchart illustrating power summing-up processing performed by a power summing-up unit 103*i*.

FIG. 24 is a flowchart illustrating the power summing-up processing performed by power summing-up unit 103*i*. The flowchart in FIG. 24 is performed as a subroutine of the processing in step S25 in FIG. 6.

Referring to FIG. 24, power summing-up unit 103*i* determines whether first power calculator 103*e* notifies power summing-up unit 103*i* of the calculation result of the power consumption amount (S401). When determining that first power calculator 103*e* notifies power summing-up unit 103*i* (Yes in S401), power summing-up unit 103*i* accumulates the calculation results of the power consumption amount, and stores the accumulated value in a memory (S411). Then power summing-up unit 103*i* goes to processing in step S403. On the other hand, when determining that first power calculator 103*e* does not notify power summing-up unit 103*i* (No in S401), power summing-up unit 103*i* goes to the processing in step S403.

Power summing-up unit 103*i* determines whether second power calculator 103*f* notifies power summing-up unit 103*i* of the calculation result of the power consumption amount (S403). When determining that second power calculator 103*f* notifies power summing-up unit 103*i* (Yes in S403), power summing-up unit 103*i* accumulates the calculation result of the power consumption amount, and stores the accumulated value in the memory (S413). Then power summing-up unit 103*i* goes to processing in step S405. On the other hand, when determining that second power calculator 103*f* does not notify power summing-up unit 103*i* (No in S403), power summing-up unit 103*i* goes to the processing in step S405.

Power summing-up unit 103*i* determines whether third power calculator 103*g* notifies power summing-up unit 103*i* of the calculation result of the power consumption amount (S405). When determining that third power calculator 103*g* notifies power summing-up unit 103*i* (Yes in S405), power summing-up unit 103*i* accumulates the calculation result of the power consumption amount, and stores the accumulated value in the memory (S415). Then power summing-up unit 103*i* goes to processing in step S407. On the other hand, when determining that third power calculator 103*g* does not notify power summing-up unit 103*i* (No in S405), power summing-up unit 103*i* goes to the processing in step S407.

Power summing-up unit 103*i* determines whether fourth power summing-up unit 103*h* notifies power summing-up unit 103*i* of the calculation result of the power consumption amount (S407). When determining that fourth power summing-up unit 103*h* notifies power summing-up unit 103*i* (Yes in S407), power summing-up unit 103*i* accumulates the calculation result of the power consumption amount, and stores the accumulated value in the memory (S417). Then power summing-up unit 103*i* goes to processing in step S409. On the other hand, when determining that fourth power summing-up unit 103*h* does not notify power summing-up unit 103*i* (No in S407), power summing-up unit 103*i* goes to the processing in step S409.

Power summing-up unit 103*i* determines whether the time is right to notify manipulation display controller 103*a* of the power amount information (S409). When determining that the time is right to notify manipulation display controller 103*a* of the power amount information (Yes in S409), power summing-up unit 103*i* notifies manipulation display controller 103*a* of the accumulated value stored in the memory as the power amount information (S421), and clears the accumulated value of the memory (S423). Then power summing-up unit 103*i* returns to the processing in step S25 in FIG. 6. On the other hand, when determining that the time is not right to notify manipulation display controller 103*a* of the power amount information (No in S409), power summing-up unit 103*i* returns to the processing in step S25 in FIG. 6.

Display Processing Performed by Manipulation Display Controller

Then power information displaying processing performed by manipulation display controller 103*a* will be described.

For example, manipulation display controller 103*a* displays the power consumption amount of the image forming apparatus on display unit 102 in each month. In this case, manipulation display controller 103*a* may display the total power consumption amount from the beginning of this month up to now and the past power consumption amount in each month.

Figure 25:
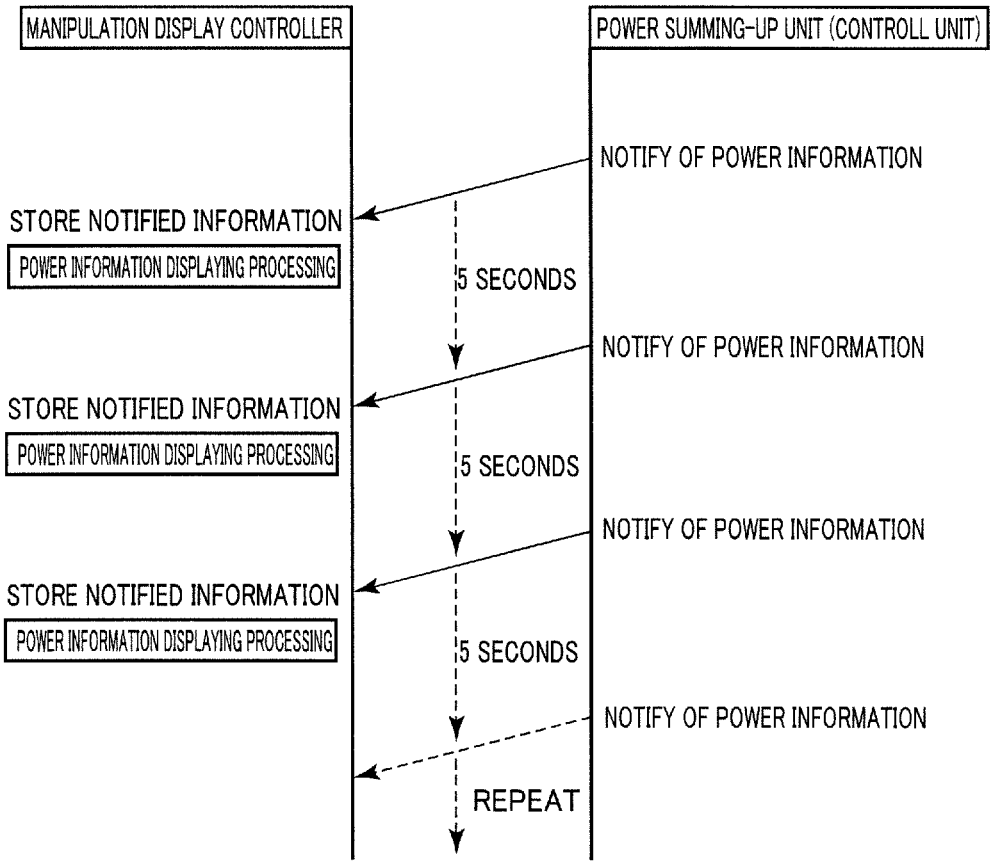
FIG. 25 is a sequence illustrating communication between power summing-up unit 103*i* and a manipulation display controller 103*a*.

FIG. 25 is a sequence illustrating communication between power summing-up unit 103*i* and manipulation display controller 103*a*.

Referring to FIG. 25, manipulation display controller 103*a* performs the power information displaying processing every time manipulation display controller 103*a* receives the notification of the power amount information from power summing-up unit 103*i* at predetermined power amount notification intervals (for example, every 5 s). Specifically, manipulation display controller 103*a* accumulates the power amount information by storing the power amount information, of which power summing-up unit 103*i* notifies manipulation display controller 103*a*, in the memory (for example, the nonvolatile RAM in ROM 333), and manipulation display controller 103*a* converts a display unit (Ws) of the accumulated value into a predetermined display unit (for example, kWh). Manipulation display controller 103*a* displays the converted accumulated value as the total power consumption value of this month on display unit 102. At the beginning of each month, manipulation display controller 103*a* stores the accumulated value as the power consumption amount of the last month in the memory (while the accumulated value is correlated with month information), and clears the accumulated value. Manipulation display controller 103*a* gathers the accumulated values as a monthly power consumption amount, and displays the monthly power consumption amount on display unit 102.

FIG. 26 is a view schematically illustrating a power information screen displayed on display unit 102.

Referring to FIG. 26, information on the past monthly power consumption amount is displayed on display unit 102 together with the power consumption amount of this month. Each of the accumulated time in the current-carrying state, the accumulated time in the standby state, the accumulated time in the power saving state, and the accumulated time in the operating state is displayed as reference information in the format correlated with the power consumption amount. Timing unit 103*j* stores the pieces of reference information in the memory (for example, the nonvolatile RAM in ROM 333).

Figure 27:
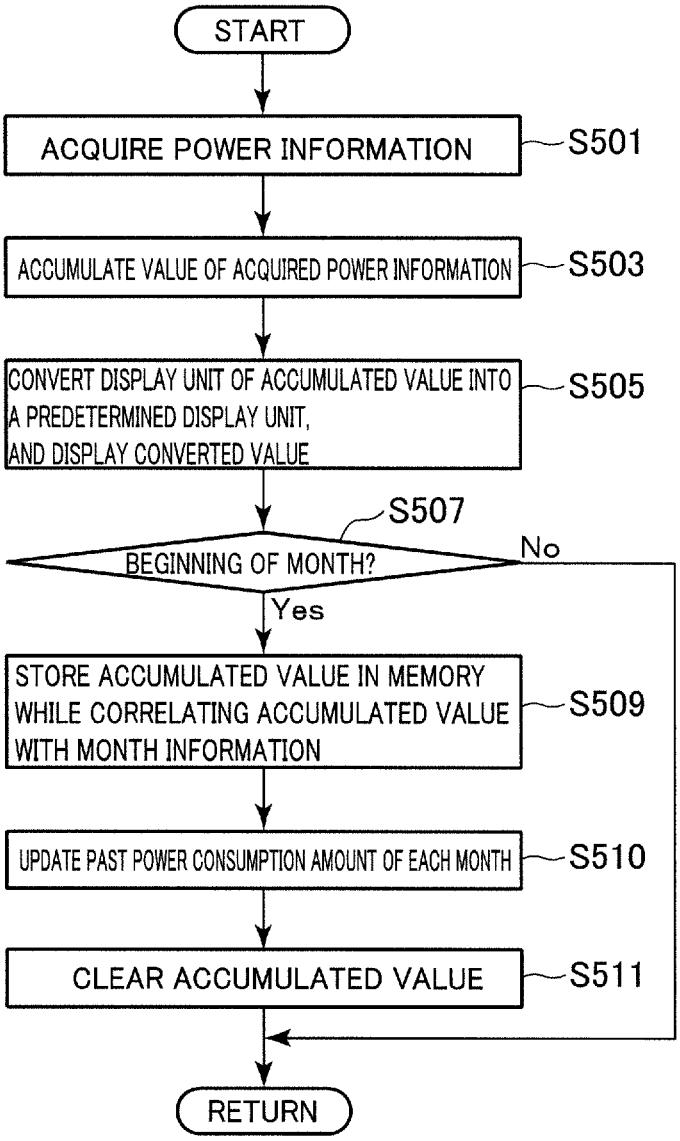
FIG. 27 is a flowchart illustrating power information displaying processing performed by manipulation display controller 103*a*.

FIG. 27 is a flowchart illustrating the power information displaying processing performed by manipulation display controller 103*a*. The flowchart in FIG. 27 is performed as the subroutine of the processing in step S25 in FIG. 6.

Referring to FIG. 27, when acquiring the power information from power summing-up unit 103*i* (S501), manipulation display controller 103*a* accumulates the value of the power information, and stores the accumulated value in the memory (S503). Manipulation display controller 103*a* converts the display unit (Ws) of the accumulated value stored in the memory into a predetermined display unit (kWh), and displays the accumulated value as the power consumption amount of this month on display unit 102 (S505). Manipulation display controller 103*a* determines whether the current time is the beginning of the month (for example, whether the current clock time is the midnight of the beginning of the month) (S507).

When determining that the current time is the beginning of the month (Yes in S507), manipulation display controller 103*a* stores the accumulated value in the memory while correlating the accumulated value with month information (S509), and updates the past power consumption amount of each month (S510). Manipulation display controller 103*a* clears the accumulated value stored in the memory (S511). Then manipulation display controller 103*a* returns to the processing in step S25 in FIG. 6. On the other hand, when determining that the current time is not the beginning of the month (No in S507), manipulation display controller 103*a* returns to the processing in step S25 in FIG. 6.

In the above case, because manipulation display controller 103*a* receives the notification of the power information in a short period of 5 seconds, the current consumption amount information can accurately be displayed in real time. On the other hand, in the case that the period in which manipulation display controller 103*a* receives the notification of the power information is lengthened, the loads on CPU 331 can be reduced.

Modification

The case that the image forming apparatus is a line-type inkjet printer will be described in a modification.

Figure 28:
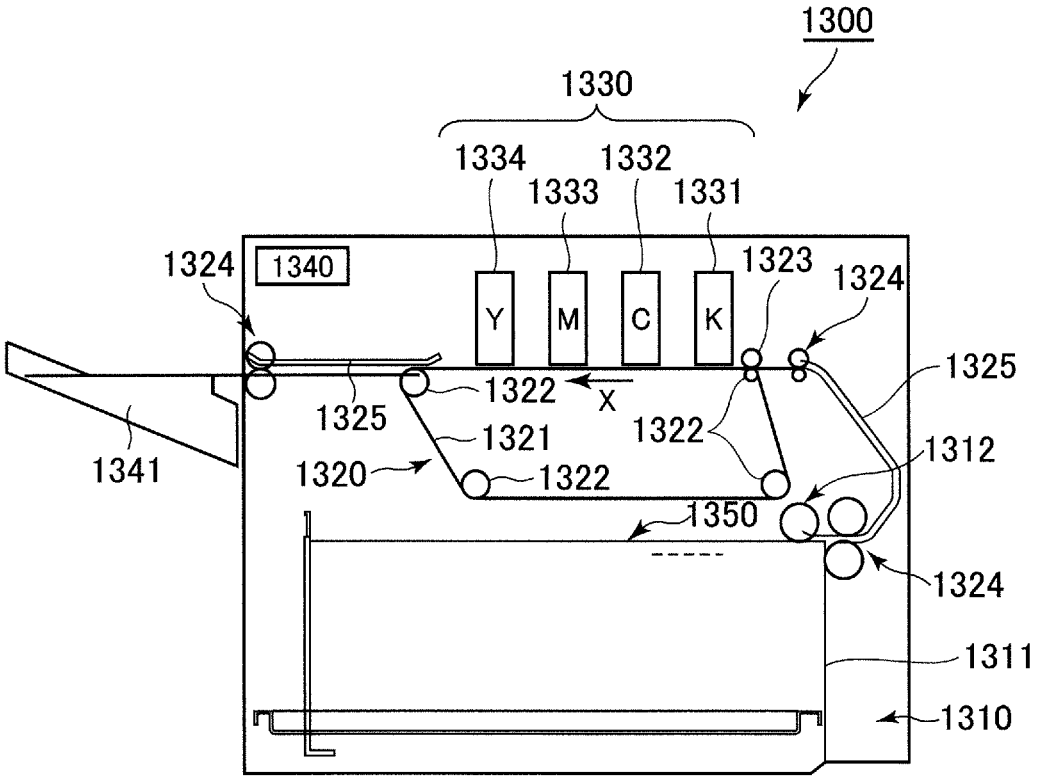
FIG. 28 is a sectional view schematically illustrating a configuration of an image forming apparatus according to a modification of the embodiment.

FIG. 28 is a sectional view schematically illustrating a configuration of the image forming apparatus of the modification of the embodiment.

Referring to FIG. 28, a line-type inkjet printer 1300 that is the image forming apparatus mainly includes a sheet feeding unit 1310, a sheet feeding conveying unit 1320, plural conveying rollers 1324, and a head-unit section 1330.

Sheet feeding unit 1310 includes a sheet feeding cassette 1311 and a takeoff device 1312. Sheet feeding cassette 1311 is provided in a lower portion of inkjet printer 1300. Plural recording sheets 1350 are stored in sheet feeding cassette 1311 while stacked. In FIG. 28, takeoff device 1312 is provided on the upper right side of sheet feeding cassette 1311, and takes off recording sheet 1350, in which the image should be recorded, one by one from sheet feeding cassette 1311.

Sheet feeding conveying unit 1320 is provided above sheet feeding unit 1310. Sheet feeding conveying unit 1320 conveys recording sheet 1350. Sheet feeding conveying unit 1320 includes a conveying belt 1321, plural belt rollers 1322, a pressing roller 1323, and a conveying roller 1324. Conveying belt 1321 is a circular belt that horizontally conveys recording sheet 1350 while supporting recording sheet 1350 in a planar state. Conveying belt 1321 is entrained about belt rollers 1322 so as to be rotatable. Pressing roller 1323 is provided in a position in which contact between conveying belt 1321 and recording sheet 1350 is started. Pressing roller 1323 contacts conveying belt 1321 such that recording sheet 1350 in the planar state is conveyed on conveying belt 1321. Conveying roller 1324 is provided in a predetermined position of a conveying path 1325.

Conveying roller 1324 conveys recording sheet 1350 along a conveying direction X. In conveying path 1325, recording sheet 1350 fed from sheet feeding cassette 1311 is conveyed to conveying belt 1321, recording sheet 1350 is conveyed along a circumferential surface of conveying belt 1321, and then recording sheet 1350 is discharged from conveying belt 1321 to a sheet discharging unit 1341.

Head-unit section 1330 includes head units 1331, 1332, 1333, and 1334 that are sequentially located in vicinities above conveying belt 1321 along conveying direction X. Head units 1331, 1332, 1333, and 1334 eject KCMY color inks to recording sheet 1350. Each of head units 1331, 1332, 1333, and 1334 is provided across a full width of conveying belt 1321.

Inkjet printer 1300 also includes a controller 1340 that controls the operation of whole inkjet printer 1300.

In inkjet printer 1300, the power consumption of each of sheet feeding unit 1310, conveying roller 1324, sheet feeding conveying unit 1320, and a motor (a motor that drives inkjet printer 1300) that drives head unit 1330 varies easily depending on the environment and the durability of the apparatus. Controller 1340 measures at least one of the total voltage and the total current, which are supplied to the motors that drives the above units, and controller 1340 calculates the power consumption based on the measured value. On the other hand, the power consumption of controller 1340 does not vary too much. Accordingly, controller 1340 predicts (calculates) the power consumption of controller 1340 based on the power consumption amount per unit time, which is predicted from the operating state of the image forming apparatus, and the operating time.

Like the modification, also in the image forming apparatus that does not include the photosensitive body, the development device, the finisher that performs the post-processing to the post-image-formation sheet, the automatic document feeder, and the motors that drive these members, the power consumption amount is calculated while divided into the portion in which the power consumption amount is predicted by the calculation and the portion in which the power consumption amount is calculated by the actual measurement. Therefore, the easy-design, high-accuracy power consumption amount can be obtained.

In addition to the line-type (line-head type) inkjet printer in which only the sheet moves with respect to head-unit section 1330 (a printhead) fixed as illustrated in FIG. 28, the inkjet printer may be a serial type inkjet printer in which the sheet is printed while the head-unit section moves.

Effect of Embodiment

According to the embodiment, the image forming apparatus that can accurately obtain the power consumption amount of the image forming apparatus can be provided. According to the embodiment, the image forming apparatus that can suppress the complication of the apparatus configuration can be provided.

According to the embodiment, the power consumption amounts of some loads are measured based on the actually-measured current, and the power consumption amounts of other loads are predicted by the method in which the actual measurement is not performed, so that the complication of apparatus configurations, such as the program related to the power calculation, can be suppressed while the accuracy of the power consumption amount to be obtained is ensured.

The accuracy of the power consumption amount can be improved by calculating the power consumption amount of the driving load unit, which varies easily according to the environment and the durability of the apparatus, based on the current.

Others

Alternatively, the power consumption amount of the load except the driving system load may be calculated based on the measured value of the current supplied to the load. The power consumption amount of the driving system load may be predicted based on the operating state and the operating time of the driving system load.

It is not always necessary that the power consumption amounts calculated by the first to fourth power calculators be the power consumption amount per 1 (s), but the power consumption amounts calculated by the first to fourth power calculators may be the power consumption amount at arbitrary time intervals.

The embodiments may properly be combined. For example, in inkjet printer 1300 in FIG. 28, the current supplied to the motor may be measured in synchronization with the control of the motor that drives inkjet printer 1300.

The pieces of processing in the embodiment may be performed by software or a hardware circuit. A program executing the pieces of processing in the above embodiments may be provided, and the program may be provided to the user while recorded in recording mediums, such as a CD-ROM, a flexible disk, a hard disk, a ROM, a RAM, and a memory card. The program is executed by computers, such as the CPU. The program may be down-loaded to the apparatus through communication lines, such as the Internet.

Although the preset invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising one or more processors and a memory operatively connected to the one or more processors, the memory storing instructions for the one or more processors to:

calculate a power consumption amount of a first load of the image forming apparatus based on at least one of measured values of a voltage and a current, which are supplied to said first load;

predict a power consumption amount of a second load of said image forming apparatus, including a fixing heater that heats a fixing device, based on an operating state and an operating time of said image forming apparatus; and calculate a power consumption amount of said image forming apparatus by summing up the calculated power consumption amount of the first load and the predicted power consumption amount of the second load.

2. The image forming apparatus according to claim 1, wherein the memory stores further instructions for the one or more processors to:

in calculating the power consumption amount of the first load, calculate a power consumption amount of a motor that drives said image forming apparatus based on at least one of measured values of a voltage and a current, which are supplied to said motor; and calculate a power consumption amount of a power supply unit that provides a potential to at least one of a photosensitive body, on which a toner image is formed, and a development device that develops the toner image on said photosensitive body based on at least one of a voltage and a current, which are supplied to said power supply unit.

3. The image forming apparatus according to claim 2, wherein said motor includes:

a motor for driving a conveying unit that conveys a sheet;

a motor for driving said photosensitive body;

a motor for driving said development device;

a motor for driving a finisher that performs post-processing to the sheet after image formation; and a motor for driving an automatic document feeder that continuously conveys a document to a document reader.

4. The image forming apparatus according to claim 1, wherein the memory stores further instructions for the one or more processors to:

in predicting the power consumption amount of the second load, calculate a power consumption amount of the fixing heater that heats the fixing device, which fixes the toner image to the sheet, based on a power input to said fixing heater and a current-carrying time of said fixing heater; and calculate a total power consumption amount of a manipulation display controller that controls a user interface related to the image formation, an image controller that outputs exposure data at each page of said sheet based on image data, a driving load controller that controls an operation of said motor, which drives said image forming apparatus, and a fixing heater controller that controls an operation of said fixing heater based on the operating state and the operating time of said image forming apparatus.

5. The image forming apparatus according to claim 4, wherein said fixing heater is a halogen heater, and the power consumption amount of said fixing heater is calculated with a rated power of said halogen heater as power input to said fixing heater.

6. The image forming apparatus according to claim 5, wherein the memory stores further instructions for the one or more processors to:

in calculating the power consumption amount of the fixing heater, correct a power consumption amount based on a change in power consumption of said fixing heater in at least one of a transient state immediately after an operation of said halogen heater is started and a transient state immediately before the operation is stopped.

7. The image forming apparatus according to claim 4, wherein said fixing heater is an induction heating heater including a coil and an induction heating power supply that supplies a power to said coil, and the power consumption amount of said fixing heater is calculated with an instruction power, of which an instruction is received by said induction heating heater, as power input to said fixing heater.

8. The image forming apparatus according to claim 4, wherein the total power consumption amount is calculated based on whether said operating state of said image forming apparatus is warm-up, power saving, standby, or printing.

9. The image forming apparatus according to claim 4, further comprising a DC power supply for supplying power to each of said first and second loads using a voltage into which a voltage of a commercial power source is converted, wherein at least one of the power consumption amount of the first load and the total power consumption amount is calculated based on conversion efficiency of said DC power supply.

10. The image forming apparatus according to claim 9, wherein the memory stores further instructions for the one or more processors to:

in calculating at least one of the power consumption amount of the first load and the total power consumption amount:

calculate a secondary-side power consumption amount, which is a power consumption amount on said first or second load side rather than said DC power supply; and calculate a primary-side power consumption amount, which is a power consumption amount on a commercial power source rather than said DC power supply, by converting said secondary-side power consumption amount calculated by said secondary-side power calculator using a conversion efficiency table indicating the conversion efficiency of said DC power supply.

11. The image forming apparatus according to claim 2, wherein in calculating the power consumption amount of the first load, the image forming apparatus measures said current supplied to said first load in a period synchronized with a period during which the operation of said motor is controlled.

12. The image forming apparatus according to claim 1, wherein said image forming apparatus does not include a photosensitive body and a development device, and in calculating the power consumption amount of the first load, the power consumption amount of a motor that drives said image forming apparatus is calculated based on a measured value of at least one of a voltage and a current, which are supplied to said motor.

13. The image forming apparatus according to claim 1, wherein the power consumption amount of said first load is calculated based on a rated output power supply of a DC power supply and a current passed through a current detector provided in a power supply route between said rated output power supply and said first load.

14. The image forming apparatus according to claim 1, further comprising:

a peripheral device; and another DC power supply for supplying power to said peripheral device using a voltage, into which a voltage of a commercial power source is converted, without receiving power from a DC power supply that supplies the power to each of said first and second loads, wherein the memory further stores instructions to:

in predicting the power consumption amount of the second load, calculate a power consumption amount of said peripheral device based on the operating state of said peripheral device.

15. An image forming apparatus controlling method comprising:

a first power calculating step of calculating a power consumption amount of a first load of said image forming apparatus based on at least one of measured values of a voltage and a current, which are supplied to said first load;

a power prediction step of predicting a power consumption amount of a second load of said image forming apparatus, including a fixing heater that heats a fixing device, based on an operating state and an operating time of said image forming apparatus; and a power summing-up step of calculating a power consumption amount of said image forming apparatus by summing up the power consumption amount calculated by said first power calculating step and the power consumption amount predicted by said power prediction step.

16. An image forming apparatus comprising:

one or more processors operatively connected to a memory, the memory storing instructions for the one or more processors to:

calculate a first power consumption amount of a first load group in said image forming apparatus;

calculate a second power consumption amount of a second load group including a fixing heater;

calculate a third power consumption amount of a third load group including a control circuit that controls an operation of said image forming apparatus; and calculate a sum power consumption amount of said image forming apparatus by summing up the first, second and third power consumption amounts, wherein said first load group includes all loads of said image forming apparatus, which are not included in said second and third load groups; and a DC power supply for supplying power to each of said first and third load groups using a voltage into which a voltage of a commercial power source is converted;

wherein at least one of the first power consumption amount and the third power consumption amount is calculated based on conversion efficiency of said DC power supply.

17. The image forming apparatus according to claim 16, wherein the memory stores further instructions to:

in calculating the first power consumption amount:

calculate a power consumption amount of a motor that drives said image forming apparatus based on at least one of measured values of a voltage and a current, which are supplied to said motor; and calculate a power consumption amount of a power supply unit that provides a potential to at least one of a photosensitive body, on which a toner image is formed, and a development device that develops the toner image on said photosensitive body based on at least one of a voltage and a current, which are supplied to said power supply unit.

18. The image forming apparatus according to claim 17, wherein said motor includes:

a motor for driving a conveying unit that conveys a sheet;

a motor for driving said photosensitive body; a motor for driving said development device;

a motor for driving a finisher that performs post-processing to the sheet after image formation; and a motor for driving an automatic document feeder that continuously conveys a document to a document reader.

19. The image forming apparatus according to claim 17, wherein in calculating the first power consumption amount, the image forming apparatus measures the current supplied to said first load group in a period synchronized with a period during which the operation of the motor that drives said image forming apparatus is controlled.

20. The image forming apparatus according to claim 16, wherein in calculating the third power consumption amount, the image forming apparatus calculates a total power consumption amount of a manipulation display controller that controls a user interface related to the image formation, an image controller that outputs exposure data at each page of the sheet based on image data, a driving load controller that controls an operation of said motor, which drives said image forming apparatus, and a fixing heater controller that controls an operation of said fixing heater based on an operating state and an operating time of said image forming apparatus.

21. The image forming apparatus according to claim 16, wherein in calculating the second power consumption amount, the image forming apparatus calculates a power consumption amount of said fixing heater based on power input to said fixing heater and a current-carrying time of said fixing heater.

22. The image forming apparatus according to claim 21, wherein said fixing heater is a halogen heater, and in calculating the second power consumption amount, the image forming apparatus calculates a power consumption amount of said fixing heater with a rated power of said halogen heater as power input to said fixing heater.

23. The image forming apparatus according to claim 22, wherein in calculating the second power consumption amount, the image forming apparatus corrects a power consumption amount based on a change in power consumption of said fixing heater in at least one of a transient state immediately after an operation of said halogen heater is started and a transient state immediately before the operation is stopped.

24. The image forming apparatus according to claim 21, wherein said fixing heater is an induction heating heater including a coil and an induction heating power supply that supplies power to said coil, and in calculating the second power consumption amount, the image forming apparatus calculates the power consumption amount of said fixing heater with an instruction power, of which an instruction is received by said induction heating heater, as the power input to said fixing heater.

25. The image forming apparatus according to claim 16, wherein in calculating the third power consumption amount, the image forming apparatus calculates the power consumption amount based on whether the operating state of said image forming apparatus is warm-up, power saving, standby, or printing.

26. The image forming apparatus according to claim 16, wherein the memory stores further instructions for the one or more processors to:

in calculating at least one of the first and third power consumption amounts:

calculate a secondary-side power consumption amount, which is a power consumption amount on said first or third load group side rather than said DC power supply; and calculate a primary-side power consumption amount, which is a power consumption amount on a commercial power source rather than said DC power supply, by converting the secondary-side power consumption amount using a conversion efficiency table indicating the conversion efficiency of said DC power supply.

27. The image forming apparatus according to claim 16, wherein in calculating the first power consumption amount, the image forming apparatus calculates the power consumption amount of said first load group based on a rated output power supply of a DC power supply and a current passed through a current detector provided in a power supply route between said rated output power supply and said first load.

28. An image forming apparatus comprising:

one or more processors operatively connected to a memory, the memory storing instructions for the one or more processors to:

calculate a first power consumption amount of a first load group in said image forming apparatus;

calculate a second power consumption amount of a second load group including a fixing heater;

calculate a third power consumption amount of a third load group including a control circuit that controls an operation of said image forming apparatus; and calculate a sum power consumption amount of said image forming apparatus by summing up the first, second and third power consumption amounts, wherein said first load group includes all loads of said image forming apparatus, which are not included in said second and third load groups;

a peripheral device; and another DC power supply for supplying power to said peripheral device using a voltage, into which a voltage of a commercial power source is converted, without receiving power from a DC power supply that supplies said power to each of said first and second load groups, wherein in calculating the first power consumption amount, the image forming apparatus calculates a power consumption amount of said peripheral device based on the operating state of said peripheral device.

29. An image forming apparatus controlling method comprising:

calculating a first power consumption amount of a first load group in said image forming apparatus;

calculating a second power consumption amount of a second load group including a fixing heater;

calculating a third power consumption amount of a third load group including a control circuit that controls an operation of said image forming apparatus; and calculating a sum power consumption amount of said image forming apparatus by summing up the first, second and third power consumption amounts;

wherein said first load group includes all loads of said image forming apparatus, which are not included in said second and third load groups;

wherein said image forming apparatus comprises a DC power supply for supplying power to each of said first and third load groups using a voltage into which a voltage of a commercial power source is converted; and wherein at least one of the first power consumption amount and the third power consumption amount is calculated based on conversion efficiency of said DC power supply.

30. A non-transitory computer-readable recording medium having a control program for an image forming apparatus stored thereon, said program being executable to control a computer to perform functions comprising:

calculating a first power consumption amount of a first load group in said image forming apparatus;

calculating a second power consumption amount of a second load group including a fixing heater;

calculating a third power consumption amount of a third load group including a control circuit that controls an operation of said image forming apparatus; and calculating a sum power consumption amount of said image forming apparatus by summing up the first, second and third power consumption amounts;

wherein said first load group includes all loads of said image forming apparatus, which are not included in said second and third load groups;

wherein said image forming apparatus comprises a DC power supply for supplying power to each of said first and third load groups using a voltage into which a voltage of a commercial power source is converted; and wherein at least one of the first power consumption amount and the third power consumption amount is calculated based on conversion efficiency of said DC power supply.

* * * * *